US011970919B2

(12) United States Patent
Rodger et al.

(10) Patent No.: US 11,970,919 B2
(45) Date of Patent: Apr. 30, 2024

(54) DOWNHOLE TOOL

(71) Applicant: NOV Downhole Eurasia Limited, Stonehouse (GB)

(72) Inventors: Philip Graham Rodger, Montrose (GB); Graeme Colin Allison, Aberdeen (GB)

(73) Assignee: Grant Prideco, Inc., Houston, TX (US)

( * ) Notice: Subject to any disclaimer, the term of this patent is extended or adjusted under 35 U.S.C. 154(b) by 464 days.

(21) Appl. No.: 17/251,385

(22) PCT Filed: Jun. 14, 2019

(86) PCT No.: PCT/GB2019/051656
§ 371 (c)(1),
(2) Date: Dec. 11, 2020

(87) PCT Pub. No.: WO2019/239146
PCT Pub. Date: Dec. 19, 2019

(65) Prior Publication Data

US 2021/0301612 A1 Sep. 30, 2021

(30) Foreign Application Priority Data

Jun. 14, 2018 (GB) ..... 1809767

(51) Int. Cl.
*E21B 23/00* (2006.01)
*E21B 10/32* (2006.01)
*E21B 23/04* (2006.01)

(52) U.S. Cl.
CPC ..... *E21B 23/004* (2013.01); *E21B 10/322* (2013.01); *E21B 23/006* (2013.01); *E21B 23/042* (2020.05); *E21B 23/0421* (2020.05)

(58) Field of Classification Search
CPC ..... E21B 10/322; E21B 23/006; E21B 34/10; E21B 23/004; E21B 34/108
See application file for complete search history.

(56) References Cited

U.S. PATENT DOCUMENTS 4,298,077 A * 11/1981 Emery ..... E21B 4/02 175/243
6,158,533 A * 12/2000 Gillis ..... E21B 7/068 175/325.1

(Continued)

FOREIGN PATENT DOCUMENTS

EP 2999848 A2 3/2016
EP 3259437 A1 12/2017

(Continued)

OTHER PUBLICATIONS

International Preliminary Report on Patentability dated Dec. 24, 2020 for Application No. PCT/GB2019/051656.

(Continued)

*Primary Examiner* — Kipp C Wallace
(74) *Attorney, Agent, or Firm* — Conley Rose, P.C.

(57) ABSTRACT

A downhole tool includes a housing; a first piston arranged within the housing such that it can move axially under the action of fluid flowing through the tool; and an indexer configured to control axial movement of the first piston between a first, second and third axial position. The indexer is configured such that the first piston can be selectively moved into the third position in accordance with a variation of a flow of fluid through the tool. A second piston is movable between a closed position in which fluid flowing through the tool is restricted from communicating with an activation chamber and an open position in which fluid flowing through the tool is permitted to communicate with the activation chamber; wherein the second piston is configured to move between the closed position and the open position in response to the first piston moving to the third axial position.

23 Claims, 27 Drawing Sheets

(56) References Cited

U.S. PATENT DOCUMENTS

| | | | | |
|---|---|---|---|---|
| 6,173,795 | B1 * | 1/2001 | McGarian | E21B 23/006 166/321 |
| 7,422,065 | B1 | 9/2008 | Wintill | |
| 9,068,417 | B2 * | 6/2015 | Swenson | E21B 23/006 |
| 10,138,684 | B2 * | 11/2018 | Adam | E21B 10/322 |
| 10,487,602 | B2 * | 11/2019 | Evans | E21B 34/106 |
| 2004/0129423 | A1 * | 7/2004 | Eddison | E21B 23/006 166/321 |
| 2005/0230119 | A1 * | 10/2005 | McGarian | E21B 23/006 166/334.4 |
| 2011/0284233 | A1 * | 11/2011 | Wu | E21B 34/06 175/428 |
| 2012/0227973 | A1 | 9/2012 | Hart | |
| 2013/0192897 | A1 * | 8/2013 | Mackenzie | E21B 23/006 175/57 |
| 2015/0191999 | A1 * | 7/2015 | Adam | E21B 23/042 166/66.4 |
| 2016/0069147 | A1 | 3/2016 | Brown | |
| 2016/0130897 | A1 * | 5/2016 | Machocki | E21B 29/00 166/240 |
| 2017/0030168 | A1 | 2/2017 | Akkerman | |
| 2018/0238131 | A1 * | 8/2018 | Mackenzie | E21B 23/006 |

FOREIGN PATENT DOCUMENTS

| | | |
|---|---|---|
| GB | 2520755 | 6/2015 |
| WO | 2014184551 | 11/2014 |
| WO | 2016132140 | 8/2016 |
| WO | 2016167764 | 10/2016 |

OTHER PUBLICATIONS

GB Patent Application No. 1809767.5 Combined and Examination Report dated Nov. 19, 2018 (7 pages).

GB Patent Application No. 1809767.5 Examination Report dated Aug. 27, 2020 (3 pages).

GB Patent Application No. 1809767.5 Examination Report dated Nov. 19, 2020 (3 pages).

International Patent Application No. PCT/NO2019/051656 International Search Report and Written Opinion dated Sep. 18, 2019 (17 pages).

* cited by examiner

DOWNHOLE TOOL

CROSS REFERENCE TO RELATED APPLICATIONS

This application a 35 U.S.C. § 371 national stage application of PCT/GB2019/051656 filed Jun. 14, 2019 and entitled "Downhole Tool", which claims priority to United Kingdom Patent Application No. 1809767.5 filed Jun. 14, 2018, each of which is incorporated herein by reference in their entirety for all purposes.

STATEMENT REGARDING FEDERALLY SPONSORED RESEARCH OR DEVELOPMENT

Not applicable.

FIELD OF DISCLOSURE

The present disclosure relates to a downhole tool, in particular a tool that can be selectively actuated. In some examples the tool may be an underreamer or circulation tool.

BACKGROUND OF THE DISCLOSURE

During the formation, preparation and use of oil and gas wells, downhole tools are used to perform a variety of tasks, for example the drilling and reaming of a well bore. In order to undertake said tasks, a tubular string—for example a drill string—comprising the respective tool may be deployed in the wellbore. The string may comprise a tool, or a number of tools, and may be deployed and descended into the wellbore until the tool reaches the desired location, at which point it may undertake the required task. Once complete, the string may be withdrawn to remove the tool or, alternatively, a different tool may be activated to undertake a different task.

Often it is undesirable for the tool to be active during the entire deployment, use and withdrawal of the tubular string and, accordingly, it is advantageous for the tool to be activated on demand. The control over the activation of conventional tools is limited and may be unreliable. Such tools often cannot be deactivated and, if they can be, they cannot be reactivated for a second time. Furthermore, such activation systems also frequently rely on dropping items down the wellbore and hence involve the irreversible blocking of a flow path through the tubular string, thus preventing or limiting subsequent use of the tubular string without the string being withdrawn and reset. Alternately, tools may be electronically controlled by hardwire or via mud telemetry. Such systems are generally complex and expensive to acquire, operate and maintain. This makes the use of said tools inflexible and restricted which, in turn, can prolong operations when tools need to be withdrawn to be replaced, deactivated or reactivated.

SUMMARY OF THE DISCLOSURE

Providing a tool which could be selectively activated, deactivated and reactivated any number of times at the control of a user would allow greater control over tool operation and increase flexibility. A tool which could be selectively activated without irreversibly changing the nature (e.g. flow path properties) of the tubular string would further increase efficiency. It would allow a tool to be activated only in certain sections of a wellbore and would result in large time savings (for example during drilling and reaming operations) as a string would not need to be withdrawn to reset a tool.

According to the disclosure is a downhole tool. The downhole tool may comprise a housing. The downhole tool may further comprise a first piston, which may be arranged within the housing such that the first piston can move axially under the action of fluid flowing through the tool. The downhole tool may further comprise an indexer. The indexer may be configured to control axial movement of the first piston between a first, second and third axial position. The indexer may be configured such that the first piston can be selectively moved into the third position in accordance with a variation of a flow of fluid through the tool. The downhole tool may comprise a second piston. The second piston may moveable between a closed position in which fluid flowing through the tool is restricted from communicating with an activation chamber and an open position in which fluid flowing through the tool is permitted to communicate with the activation chamber. The second piston may be configured to move between the closed position and open position in response to the first piston moving to the third axial position.

There are described improved downhole tools. The downhole tool may be an actuable, e.g. selectively actuable tool—for example improved bypass tools or reamers. The downhole tool may be reconfigurable between an active and inactive arrangement. The disclosed examples provide a user with an increased level of control over the activation of the tool, allowing a user to more reliably activate and deactivate the tool on demand.

The increased control provided by the tool according to examples described herein allows wellbores to be produced and used more accurately and reliably, as tools can be activated only at the location and time at which they are required and can subsequently be deactivated.

Examples according to the disclosure also allow a user to activate and deactivate the tool as many times as possible without altering the characteristics of the tubular string (for example by obstructing flow paths through the tubular string). This can provide significant time savings as it will avoid the need for tubular strings to be withdrawn from a wellbore to replace a tool which can no longer be activated.

The arrangement of the present disclosure provides a compact arrangement, suitable for implementation in a wide range of tools. The use of movable pistons is an advantageous arrangement as the operation of such is reliable, hence providing a robust and reliable tool. Examples of the present disclosure are also easy to manufacture, install and operate.

The tool may be reconfigurable between an active and inactive arrangement in response to the activation chamber being permitted to communicate with fluid flowing through the tool. The tool may be configured such that fluid entering the activation chamber may reconfigure the downhole tool between an active and an inactive arrangement.

The tool may be a selectively activated tool. The tool may be activated or deactivated in response to fluid flowing through the tool being able to enter the activation chamber. The tool may be activated or deactivated under the action of fluid in the activation chamber. The tool may comprise a tool piece configured to move between an active and inactive position; the tool piece may move between an active and inactive position under the action of fluid in the activation chamber in response to the second piston moving to the open position. The tool may be activated or deactivated by the first piston moving to the third position. The first piston may move to the third position under the action of fluid flowing through the tool. The tool may be activated or deactivated in response to the second piston moving between the open and the closed position.

The tool may be activated and deactivated by varying fluid flow through the tool. The tool may be selectively activated, deactivated and reactivated on demand. As such, the same tool may be used in multiple sessions in the same wellbore, without the string in which the tool is included having to be withdrawn, reset and redeployed.

As the tool may be selectively activated and deactivated by varying the flow of fluid through the tool, the user may readily activate, deactivate and reactivate the tool without the need for significant, expensive or complicated additional equipment on the surface.

The tool may be configured to permit fluid to flow therethrough before it is activated, when it is active and when it has been deactivated. Accordingly, if the tool is included in a drill string, for example as a reamer arranged either in the bottom hole assembly (BHA) or above the BHA, the activation status of the reamer may not affect the flow of drilling fluid through the tool. That is, fluid may be able to flow through the tool regardless of the activation-status of the tool. The tool is therefore suitable for use in a range of applications since the tool does not restrict the flow of fluid through a string in which it is installed. Furthermore, access is provided through the tool, for example to retrieve a nuclear source from a measurement tool.

The tool may form part of a tubular string. The tool may be a tubular. The tool may be integral with a tubular string.

One of, or both of, the axial ends of the tool or housing may comprise a connector for connecting to an adjacent tubular in a string. The connector may comprise a male or female connector, for example pin and box connector. The connector may be in accordance with an international standard, such as that of the American Petroleum Institute.

Alternatively, the tool (or housing thereof) may be integrally formed as part of a larger apparatus, such as an extended tubular comprising several other tools or downhole devices.

The housing may be a tubular housing. The housing may define a first axis along the centre of the housing. The housing may be arranged to house and locate the other components of the tool.

The tool (or housing thereof) may comprise a tool flow path. The tool flow path may allow fluid (for example drilling fluid) to flow axially through the tool, for example from an uphole end to a downhole end.

The tool flow path may be an axial flow path along the centre (e.g. centreline) of the tool. The tool flow path may be arranged as an unobstructed flow path, for example through the centre of the tool. The tool flow path may be arranged to permit a flow rate sufficient to facilitate standard drilling and/or production operations. The tool flow path may be arranged such that items dropped from the surface, e.g. to activate components downhole of the tool, can pass through the tool unobstructed. The tool may be arranged such that the tool flow path is unaffected by the position of the first piston.

The first piston may be arranged axially within the housing, for example along the central axis of the housing. The first piston may be arranged at an uphole, or downhole end of the tool. The first piston may comprise a rod and a head. The first piston head may be arranged at an uphole end of the first piston. The first piston head may alternatively be arranged at a downhole end of the first piston. The first piston may be configured to seal against an inner surface of the housing. Alternatively, the first piston may be configured to seal against an inner surface of a sleeve arranged concentrically within the housing.

Throughout the present disclosure the terms first direction and second direction are used. The first direction may be axially from the first piston towards the second piston. The second direction may be axially from the second piston towards the first piston. It is to be understood that in some examples, the first direction may be a downhole direction and the second direction may be an uphole direction. However, in other examples, the first and second directions may be an uphole and downhole direction, respectively.

The first piston may be configured to allow fluid to flow therethrough. The first piston may define part of the tool flow path. The first piston rod—which may be aligned axially along the centre of the housing—may be tubular such that fluid can flow axially through the first piston. The first piston head and first piston rod may comprise a central bore through which fluid can flow. The first piston may be configured to allow sufficient fluid to flow therethrough such that drilling operations can be undertaken downhole with the drilling fluid flowing through the first piston.

The tool, or housing thereof, may comprise an annular support for locating and supporting the first piston (or rod thereof) to ensure the first piston maintains alignment within the housing. The first piston rod may extend from the first piston head and may comprise a free end at its end opposite to the first piston head. The annular support may be a balance piston.

The first piston may be configured to abut the second piston. The first piston may be configured to abut the second piston when the first piston is in the third position. The free end of the first piston rod (that not connected to the first piston head) may be configured to abut the second piston.

The tool may comprise a biasing member arranged to bias the first piston. This biasing member may be a first biasing member. The biasing member may be a helical spring. The helical spring may be located in the housing and arranged to bias the first piston in the second direction.

The first piston may be axially biased in a second direction. The first piston may be biased away from the indexer, second piston and/or activation chamber.

The first piston may be configured to move the second piston between the open and closed positions as the first piston goes to the third position. The first piston may be configured to urge the second piston from an open position to a closed position, or from a closed position to an open position, as the first piston goes to the third position. The first piston may be configured to urge the second piston in the first direction. The first piston may be configured to urge the second piston in an uphole or downhole direction.

In addition to the features described herein with respect to the indexer, the indexer may comprise any of the features of the actuator disclosed in International Patent Application Publication No. WO2016/132140. Comments made in WO2016/132140 with respect to the actuator applying, mutatis mutandis, to the indexer of the present disclosure. As such, the contents of WO2016/132140 is hereby incorporated by reference.

The indexer may control the axial movement of the first piston. The indexer may be configured to define a first, second and third position of the first piston. The indexer may be arranged to cooperate with the first piston and/to define a first, second and third axial position of the first piston. Alternatively, if the indexer is part of the first piston, the indexer may be arranged to cooperate with the housing and/or a component axially-fixed relative to the housing to define a first, second and third axial position of the first piston. The indexer may be configured to control axial movement of the first piston between the first, second and third positions in accordance with a variation in flow through the tool.

In the first position, the first piston may be arranged in an uphole position. In the third position, the first piston may be arranged in a downhole position. The second position may be arranged in the first direction from the first position. The third position may be arranged in the first direction from the first and second position.

In the third position (or when moving into the third position), the first piston may urge (directly or indirectly) the second piston from one of a closed and open position to the other of the closed and open position. In the second position, the first piston may be axially arranged between the first and third positions (i.e. downhole of the first position and uphole of the third position).

The first biasing means may be arranged to bias the first piston towards the first position.

The tool may be configured such that the piston can move between the first, second and third positions by varying the flow of fluid through the tool. The tool may be configured such that the first piston can be selectively moved into the third position by varying the flow of fluid through the tool. It is to be understood that in other examples according to the disclosure, the indexer may be configured such that a user can selectively move the first piston (for example into the third position) by varying an operating parameter of the string, tool or fluid. Any comments made herein in relation to varying the flow of fluid through the tool applies, mutatis mutandis, to varying an operating parameter in such examples.

The tool (or first piston/indexer thereof) may be configured such that when no fluid is flowing through the tool, the first piston is in the first position. The first biasing means may hold the first piston in the first position.

The tool (or first piston/indexer thereof) may be configured such that when the flow of fluid through the tool is increased, the first piston moves from the first position towards the second position (e.g. due to a pressure differential across the first piston). As the first piston is urged against the first biasing means in the first direction (e.g. towards the second piston and in a downhole direction), the indexer may direct the first piston to the second position. After a certain period of time, the first piston may reach the second position. The first piston may stay in the first position as long as the flow of fluid remains unchanged.

In moving towards the second position, the first piston may have moved axially towards the second piston. The second position may be a short stroke position. The first piston may have moved in the first direction towards the second piston, but not far enough to move the second piston between the open and closed position.

If the fluid flow is changed—e.g. the flow rate is reduced or fluid is stopped from flowing through the tool—the pressure differential across the first piston may reduce. Accordingly, the first biasing means may bias the first piston back towards the first position. If the flow rate is maintained at a low level (i.e. the operating parameter is left unchanged after the reduction) for a predetermined period of time, the first piston and indexer may be configured such that the first piston will return to the first position.

The indexer may be cyclable such that the first piston cycles between the first and second positions. The indexer may be configured such that the first piston can cycle between the first position and the second position (e.g. without affecting the second piston). The second piston may not be moved between the first and second position by the first piston cycling between the first and second positions. Accordingly, the indexer may be configured such that the tool may avoid being activated unintentionally by flow changes during normal use of the string.

If, however, the flow of fluid is changed (e.g. increased) to urge the first piston in the first direction (e.g. towards the second piston and second position) during the transition between the second position and the first position, the indexer may be configured such that the first piston moves to the third position.

The indexer may be configured such that, in order to move the first piston to the third position, the flow of fluid through the tool must be modified (for example to urge the first piston towards the second piston, second position and/or in the first direction) during the transition from the second position to the first position.

The indexer may be configured such that, in order to move the first piston to the third position, the fluid flow must be changed (e.g. the flow rate must be reduced) such that the first piston starts moving from the second position towards the first position, but then changed again (e.g. the flow rate is increased) during a transition period between the second and first positions.

The indexer may be configured such that the first piston moves to the third position in response to a variation/change (e.g. increase) of the rate of fluid flow through the tool during the transition from the second position to the first position. The indexer may be configured such that the first piston moves to the third position in response to a change (e.g. increase) of the rate of fluid flow through the tool before the first piston reaches the first position from the second position.

The indexer may be configured such that the first piston moves to the third position in response to the flow rate through the tool being increased or decreased shortly after the flow rate is decreased or increased, respectively. The indexer may be configured such that the first piston moves to the third position in response to the flow rate through the tool being increased or decreased within a predetermined period of the flow rate being decreased or increased, respectively. The predetermined period may be 10 seconds, 30 second, 1 minute, 5 minutes, 10 minutes, 20 minutes, 30 minutes or one hour.

Accordingly, a user may activate or deactivate the tool by implementing a sequence of relatively quick changes in the flow of fluid through the tool. Changes in flow rate which are typically required for normal use of a string are unlikely to include such quick changes in the flow rate and, as such, are unlikely to inadvertently activate or deactivate the tool.

The indexer may be configured such that in order to move the first piston from the first position to the third position, a sequence of flow control actions must be undertaken, for example a predetermined sequence of flow control actions each of which may, for example, vary the flow through the tool. The predetermined sequence of flow control actions may comprise 2, 3, 4, 5 or more than 5 actions.

The tool may be configured such that the first piston is in the first position when no fluid is flowing through the tool, is in the second position when fluid is flowing through the tool but the predetermined sequence of flow control actions has not been undertaken, and the third position when fluid is flowing through the tool and the predetermined sequence of flow control actions has been undertaken.

The predetermined sequence of flow control actions may comprise increasing the flow rate to move the first piston from the first position to the second position. The predetermined sequence of flow control actions may comprise reducing the flow rate such that first piston moves from the second position towards the first position. The predetermined sequence of flow control actions may comprise increasing the flow rate during a transition between the second position and first position to move the first piston to the third position.

In some examples, the predetermined sequence of flow control actions may comprise the actions before increasing the flow rate during a transition between the second position and first position to move the first piston to the third position: increasing the flow rate during a transition between the second position and the first position to move the first piston to an intermediate position, equivalent to that of the second position; and reducing the flow rate such that the first piston moves from the intermediate position towards the first position.

The indexer may be configured to control axial movement of the piston into and out of an intermediate position. The indexer may be configured to define an intermediate position of the first piston. The intermediate position may be equivalent to that of the second position. It may require the same sequence of actions described above as being required for entering the third position. The presence of an intermediate position may require a longer sequence of actions to enter the third position and, as such, reduces the risk that the third position is entered unintentionally.

The indexer may be axially-fixed relative to the first piston. The indexer may be part of the first piston. As such, the first piston may comprise the indexer. The indexer may be fixed relative to the first piston. The indexer may be arranged on an outer or inner circumferential surface of the first piston.

Alternatively, the indexer may be independent from or separate to the first piston. The indexer may form part of the housing.

The indexer may be independent of or separate to the housing and the first piston.

The indexer may be an indexer sleeve. The indexer may surround part of the first piston or the rod thereof. The indexer may be integral with the housing or the first piston.

The indexer may be arranged to rotate relative to one of, or both of, the first piston and the housing. The indexer being free to rotate relative to the first piston and housing permits operation of the tool without requiring rotation of the first piston relative to the housing.

The tool may comprise a bearing (e.g. a roller bearing) arranged to allow the indexer to rotate relative to the tool. The bearing may be located on the inner or outer radial surface of the indexer arranged such that the indexer is free to rotate relative to the housing, first piston or the mounting surface on which it is arranged.

The tool may comprise a thrust bearing arranged at one of, or both of, the axial ends of the indexer.

The indexer may be mounted on the first piston or on a cylindrical mounting surface within the housing.

An end surface of the indexer may comprise a profile configured to abut the first piston (e.g. the follower) when the first piston is in the first, second and/or third position to transfer axial loads.

The profile may comprise a first surface at a first axial location arranged to provide load-bearing surface when the piston is in the first or second position, and a second surface at a second axial location arranged to provide a load-bearing surface when the piston is in the second or third position.

The indexer may comprise a castellated profile configured to abut the first piston (e.g. follower) when the first piston is at at least two of the first, second and third position.

The first piston (e.g. the follower or an end face thereof) may comprise a complementary profile.

The indexer may comprise a plurality of paths. The plurality of paths may be defined by channels or slots on its inner or outer surface. The plurality of paths may define a pathway profile.

The pathway profile may define the first position, the second position and the third position of the first piston.

The paths may be configured to receive a protrusion (e.g. a pin). The protrusion may be axially-restrained relative to the housing (e.g. if the indexer is axially-restrained with respect to the first piston), or axially-restrained relative to the first piston (e.g. if the indexer is axially-restrained with respect to the housing). The paths may be configured to define the travel of a pin at least in the axial direction and to limit the axial movement of the pin. The pin may be biased into engagement with the pathway profile—e.g. towards the paths/pathway profile.

The indexer may comprise a first path which defines the transition of the first piston from the first position to the second position. The indexer may comprise a second path which defines the transition of the first piston from the second position to the first position.

The indexer may comprise a third path which defines the transition of the first piston to the third position. The third path may lead from the second path to the third position. The third path may branch off from the second path. The third path may be arranged such that when the direction of transition along the second path is reversed, the third path is entered.

One of or each path may comprise a channel defined into the outer or inner surface of the indexer.

One of the paths may have a different depth (e.g. be recessed to a greater or lesser extent in a radial direction) to another of the paths. The pathway profile may comprise a change in depth. One/multiple of the paths of the indexer (or one/multiple of the paths) may define a change in depth. The change in depth may be a step or a gradient.

A change in depth may be defined at the intersection of two of the paths. The change in depth may define a difference in depth between the corresponding paths. The change in depth may be arranged to reduce the chance that a pin in one of the two paths enters the other of the two paths.

The first path may comprise a change in depth at its first position end or second position end.

The second path may comprise a change in depth at its second position end or its first position end.

The third path may comprise a change in depth at its start (e.g. adjacent the second path) or at its third position end.

The change in depth may be arranged to prevent, or reduce the likelihood of, the first piston moving between the first, second and/or third position out of sync, by accident or inadvertently. The change in depth arranged to prevent, or reduce the likelihood of, the first piston going straight from the first position to the third position. The paths may define a change in depth arranged to prevent, or reduce the likelihood of, the first piston going from the third position to the second position.

The first, second and third paths may define an initial position, a short stroke and a long stroke. The short stroke may be defined by the second position of the first piston. The long stroke may be defined by the third position of the first piston.

A single channel or slot may constitute part of multiple paths (e.g. part of the first and second, second and third, first and third, etc).

Further, intermediate paths which may mirror those of the first and second paths may be arranged between the second and third paths. Intermediate paths may lead to intermediate positions of the first piston. Intermediate paths may be arranged to branch off from the second path but have a similar arrangement to the first path (and thus lead to an intermediate position which mirrors—for example in terms of axial position of the first piston—the second position). The inclusion of intermediate paths may cause a longer sequence of operational parameter actions (e.g. specific changes in flow rate) being required to enter the third position.

The indexer may comprise two, three, four or more than four sets of paths. Each set of paths may comprise any or all of the paths described above. The sets of paths of the indexer may be arranged around the circumference of the indexer in a rotationally symmetric manner. The pathway profile may be continuous around the circumference of the indexer.

The first piston may be configured to engage the indexer such that the extent of movement of the first piston is controlled by the indexer.

Alternatively, the housing may be configured to engage the indexer such that the extent of the movement of the first piston is controlled by the indexer.

In examples where the first piston comprises the indexer, the tool may comprise a component axially-fixed relative to the housing arranged to engage the indexer such that the extent of movement of the first piston is controlled by the indexer. The component may be a pin. The pin may be arranged to protrude radially within the housing. The pin may be arranged to engage a pathway profile of the indexer. The tool may comprise a pin which is axially fixed within the housing but is free to rotate (about the axis of the tool) relative to the housing.

The first piston may comprise a follower. The follower may be axially or rotationally and axially fixed with respect to the first piston or integral with the first piston. The follower may be configured to engage the indexer (for example when the indexer is axially fixed relative to the housing rather than the first piston). The follower may be configured to restrict the movement of the first piston to that defined by the indexer.

The follower may comprise a piston or piston section. The follower (or the piston portion thereof) may be sealingly attached to the first piston. The follower may be configured to seal against the inside surface of the housing.

The follower may comprise a sleeve or sleeve section. The follower (or sleeve portion thereof) may be arranged (for example concentrically) within, or to surround, the indexer. The follower and indexer may be arranged such that, as the follower moves axially with the first piston (e.g. with respect to the indexer), one of the indexer and the follower axially moves in and out of the other of the indexer and the follower.

The follower may be arranged to surround the indexer (e.g. a sleeve portion of the follower may have an internal radius larger than the outer radius of the indexer). The follower may be arranged to slide over the indexer as the first piston moves to the third position. This provides a compact arrangement.

The follower may comprise a protrusion, e.g. a pin, arranged to engage the indexer. The pin may be arranged to mate with or engage the paths of the indexer. The pin may project radially (outwardly or inwardly) with respect to the follower (e.g. the sleeve portion thereof). The follower may comprise a plurality of pins, e.g. diametrically opposite from each other or at 90 degree intervals from each other. The follower may comprise one pin for each set of paths of the indexer.

The follower may comprise a biasing member arranged to bias the protrusion (e.g. the pin) towards the indexer. The biasing member may be a wave spring.

The follower may comprise an abutment surface, a plurality of abutment surfaces or an end profile configured to abut the end profile of the indexer in order to transfer axial loads therebetween, as discussed above.

The follower may be configured to damp the movement of the first piston. By damping the movement of the first piston, the follower may be configured to reduce the speed at which the first piston moves. By damping the movement of the first piston, the piston may be movable into the third position more easily and/or reliably.

The follower may be configured to damp the movement of the first piston in one direction (for example, one direction only). This may provide the benefit of damping discussed above, without slowing the movement of the piston at all times. The follower may be configured to damp the movement of the first piston in the second direction. The follower may be configured to damp the movement of the first piston from the second position towards the first position. The follower may be configured to damp the movement of the piston away from the second piston. Alternatively, the follower may be configured to damp the movement of the first piston in the opposite direction to that discussed above.

The follower may be configured to damp the movement of the first piston in both directions. The follower may be configured to damp the movement of the first piston by a first amount in the first direction, and by a second amount in the second direction. The follower may be configured to damp the movement of the first piston by a first amount in a direction from the first to the second position, or towards the second piston, and by a second amount in a direction from the second position to the first position, or away from the second piston. The first amount may be smaller, or larger, than the second amount.

The follower may define a restriction to flow. The follower may be arranged such that, as the first piston moves, fluid flows through a restriction to flow defined by the follower. The fluid flowing through the restriction to flow may damp the movement of the follower, and hence the first piston. The use of a restriction to fluid flow is an effective and reliable means for damping the first piston.

The follower may define a first restriction to flow for fluid flowing in one direction and a second restriction to flow for fluid flowing in the other direction. The first restriction to flow may be larger (i.e. more restrictive) or smaller than the second restriction.

The follower may be arranged in a chamber, which may be sealed (for example with respect to the tool flow path, activation chamber and/or annulus). The indexer may also be arranged in the chamber. The housing may define a chamber in which the follower is configured to move axially. Any one or combination of the housing, first piston and indexer may collectively define and seal a chamber in which the follower is arranged to move axially. The chamber may comprise fluid. The chamber may comprise a viscous fluid, for example silicone oil. The use of a sealed chamber system ensures that the damping mechanism is not affected by the ingress of particles from outside of the tool.

The follower and chamber may be arranged such that, as the follower moves axially within the chamber (either in one, or both directions as discussed above), fluid within the chamber flows from one side of the follower to the other side of the follower, via the restriction to flow (e.g. first and/or second restrictions to flow) defined by the follower.

The follower may comprise a flow control valve. Fluid may flow through the flow control valve when the first piston moves. The flow restriction(s) may comprise the flow control valve. The use of a valve allows the flow restriction and hence damping effect to be easily quantified and controlled.

The flow control valve may be a bi-directional flow control device. The flow control valve may be configured to provide a first restriction to flow to fluid flowing through the valve when the first piston moves in the first direction and a second restriction to flow to fluid flowing through the valve when the first piston moves in the second direction. The first and second restrictions to flow may be different. The first restriction to flow may be lower than the second restriction to flow.

The follower may comprise a check valve. The check valve may be configured to allow fluid flow in only one direction. The check valve may be configured to allow fluid to flow in one direction, but not the other direction. The check valve may be configured to permit flow through the check valve when the first piston is moving in the first direction (e.g. from the first position to the second position, or towards the third position). The check valve may be configured to prevent fluid flow therethrough when the first piston is moving in the second direction (e.g. from the second position to the first position, or as the first piston is moving away from the second piston).

The follower (optionally in combination with the indexer or housing) may define an annular restriction. The follower may be arranged in a chamber containing a viscous fluid, such as silicone oil, and the follower may define an annular restriction through which the silicone oil flows as the follower moves within the chamber. The restriction to flow provided by the annular restriction may damp the movement of the follower.

The follower may comprise a check valve and a flow restriction valve to provide a first restriction to flow one in direction and a second restriction to flow in the other direction. Such an arrangement may allow the follower to damp the movement of the first piston in the second direction (e.g. from the second position to the first position) more than in the first direction (e.g. from the first position to the second position). Such an arrangement will increase the duration of the window during which a change of flow rate is required to enter the third position, without unduly prolonging the time it takes for the first piston to enter the third position once the flow rate has been changed (for example).

The indexer may be configured to provide the above functionality discussed in relation to the follower. Accordingly, comments made herein relating to the follower and, in particular, comments relating to the form of the follower, the follower being located within a chamber and the follower being configured to damp the movement of the first piston may apply, mutatis mutandis, to the indexer when the indexer is axially-fixed relative to the first piston. As such, the indexer may be fixed relative to the first piston, may comprise a piston and sleeve portion and may be configured to damp the movement of the first piston as described above.

The second piston may comprise an assembly of parts (for example a sealing part and an activation chamber closing part). The second piston may comprise a piston assembly.

The second piston may be a valve member. These terms may be used largely interchangeably in the present disclosure and, as such, any comments made with respect to the second piston apply equally to the use of the term valve member.

The second piston may be arranged within the housing. The second piston may be coaxial with the first piston. The second piston may be located downhole of the first piston. The second piston may be located in a first direction with respect to the first piston. The second piston may be arranged such that the first piston does not contact the second piston when the first piston is in the first and second positions. The second piston may be arranged such that the first piston can directly or indirectly abut, engage or interact with the second piston when the first piston is in the third position.

The second piston may be configured to allow fluid to flow therethrough. The second piston may define part of the tool flow path. The second piston—may be aligned axially along the centre of the housing—may be tubular such that fluid can flow axially through the second piston. The second piston may seal against the housing or a sleeve fixed relative to the housing. The second piston and first piston rod may comprise a central bore through which fluid can flow.

The second piston may be arranged to selectively restrict/permit fluid in the tool flow path from communicating with/entering the activation chamber.

The tool piece may move between an active and inactive position in response to movement of the second piston between the open and closed positions. The tool may activate or deactivate in response to the second piston moving between the open and closed positions.

The second piston may be located adjacent an activation chamber. The second piston may be configured to move between two positions—an open and a closed position. In the open position, the second piston may be arranged such that fluid can enter the activation chamber, e.g. such that it does not restrict the flow of fluid into the activation chamber. That is, in the open position the activation chamber may be open.

In the closed position, the second piston may be arranged to restrict the flow of fluid into the activation chamber. The second piston may partially or substantially close the activation chamber when in the closed position.

The second piston may be arranged to move axially (with respect to the housing and/or the first piston) between the open and closed positions.

The second piston may be biased, for example axially biased. The second piston may be axially biased in the second direction. The second piston may be biased in a direction towards the first piston. The tool may comprise a second biasing member arranged to bias the second piston. The second biasing member may be a helical spring. The second biasing member may be located in the housing and arranged to bias the second piston in the second direction (e.g. towards the first piston).

The first piston, second piston, first biasing member and/or second biasing member may be configured such that, when fluid flows through the tool, the force exerted by the fluid on the first piston in a direction towards the second position is larger than the force exerted by the first biasing member, second biasing member and/or any force exerted on the second piston in the opposite direction. That is, the first piston may be configured such that the axial surface area provided is sufficient to ensure a force caused by the pressure gradient during use is large enough to overcome any axial forces acting in the second direction generated by the first biasing member, second biasing member, any pressure gradient across the second piston and/or any other axial forces which may resist the movement of the first piston.

The second piston may be biased towards the open position or the closed position. Thus the default state of the tool may be the activation chamber being in communication with fluid flowing through the tool, or communication between the activation chamber and fluid flowing through the tool being restricted. Accordingly, the second piston may be moved from an open position to a closed position in response to the first piston moving to the third axial position, or from a closed position to an open position in response to the first piston moving to the third axial position. That is, actuation of the tool by undertaking the predetermined sequence of flow control actions may open the actuation flow path or close the actuation flow path.

The second piston may define an opening or a plurality of openings (e.g. ports) arranged to define an entry to the activation chamber (e.g. for fluid flowing through the tool/from the tool flow path) when the second piston is in the open position. The openings may be arranged to be blocked or closed when the second piston is in the closed position.

The tool may comprise a gate member. The gate member may comprise an assembly of parts. The gate member may be arranged around the second piston. In other examples, the gate member may be arranged inside the second piston and the second piston. The second piston may be arranged to move axially within the gate member.

The gate member may comprise an opening or a plurality of openings. The openings in the gate member may be to the activation chamber. The openings may be arranged to provide access to, or communicate with, the activation chamber. The openings in the second piston may be arranged to align with those of the gate member when the second piston is in the open position. When the second piston is in a closed position, the openings of the second piston may be arranged adjacent a wall of the gate member. The wall of the gate member may restrict the flow of fluid into the activation chamber through the openings of the second piston. The wall of the gate member may shut the openings of the second piston.

The tool may comprise an activation chamber. The activation chamber may be a flow path, e.g. an activation flow path. The activation chamber may comprise a passage. The activation chamber may be for use in moving a tool piece between an active an inactive arrangement. The activation chamber may be configured to use fluid flowing through the tool flow path to actuate the tool piece. The activation chamber may use movement of the fluid through the activation chamber or static pressure to activate/deactivate the tool (e.g. move a tool piece).

The tool may comprise a plurality of activation chambers, each associated with a tool piece. Each activation chamber may be in accordance with the comments provided herein relating to a single activation chamber.

The activation chamber may be arranged such that the tool is activated (for example a tool piece moves to an active position) in response to the second piston moving to the open position.

The activation chamber may be arranged to connect the tool flow path to a tool piece (e.g. a cutter blade) to be actuated/deactivated. The activation chamber may be defined by the housing. The activation chamber may be arranged such that, when the second piston is in an open position and hence the activation chamber is exposed to fluid flowing in the tool flow path (e.g. when the fluid flowing through the tool can enter the activation chamber), the tool piece is moved either to an active or inactive arrangement under the action of the fluid.

The tool may be arranged such that, when the second piston is in the open position, the pressure in the activation chamber is increased (e.g. equivalent to that of the fluid in the tool flow path). The high pressure may be used to actuate a tool piece to/from an active position.

The tool may be arranged such that, when the second piston is in the closed position, the pressure in the activation chamber is decreased (e.g. lower than that of the fluid in the tool flow path). The lower pressure may permit the tool piece to move in the opposite direction to that caused by the high pressure (for example under the action of a biasing means, or inherent forced caused in the use of the tool piece).

The activation chamber may comprise a pressure chamber. The pressure chamber may be configured such that, when the second piston is in an open position, fluid in the pressure chamber exerts a force (either directly or indirectly) on the tool piece, thus moving the tool piece between an active and inactive position.

The tool may comprise an outer flow restriction. The outer flow restriction may be arranged between the activation chamber and the annulus (e.g. the outer surface of the housing) and may fluidically communicate with the annulus and the activation chamber. The outer flow restriction may define a pressure drop between the activation chamber and the annulus. The outer flow restriction may be configured to determine the pressure in the activation chamber when the second piston is in the third position. The outer flow restriction may be configured to provide a greater resistance to flow than the openings of the second piston and/or the gate member when the second piston is in an open position.

The outer flow restriction may permit fluid to flow through the activation chamber. The outer flow restriction may control the pressure in the activation chamber when the first piston is in the third position such that it is different to the fluid pressure in the tool flow path when the first piston is in the first or second position. This may allow a user to identify when the first piston is in the third position and the tool is active/inactive.

The outer flow restriction may be a flow control valve.

The tool may comprise a tool piece actuator. The tool piece actuator may be configured to move under the action of fluid in the activation chamber to move the tool piece between an active and inactive arrangement.

The tool piece actuator may comprise a block, wedge, plug or lever arranged to move the tool piece between an active and inactive arrangement. The tool piece actuator may be configured to slide, displace or rotate under the action of fluid in the activation chamber. The tool piece actuator may, for example, be configured to move the tool piece to an extended position when under the action of fluid in the activation chamber.

The tool piece actuator may be located in, or adjacent, the pressure chamber.

The tool piece actuator may abut, or be connected to, the tool piece.

The tool may comprise a tool piece. The tool piece may be the component which undertakes the function of the tool. The tool piece may comprise substantially any existing tool component for use in well formation, maintenance or use. The tool piece may comprise any tool component which may need to move between an active and inactive arrangement.

Examples of such tool pieces may include cutter blades, for example for use in a hole opener, near bit reamer or string reamer; formation testing equipment; packers; etc.

The tool piece may be configured to move to between an active and inactive position in response to the second piston moving to the open position. The tool piece may be configured to move to an active arrangement in response to the second piston moving to the open position. The tool piece may be configured to move between an active and inactive position under the action of fluid in the activation chamber. The tool may be configured such that the increase in pressure in the activation chamber causes the tool piece to move to an active arrangement. The active arrangement may correspond to the tool piece extending from the tool housing.

The tool piece may be configured to move to an inactive arrangement in response to the second piston moving to the closed position (e.g. due to the pressure in the activation chamber reducing). The tool may be configured such that the reduction in pressure in the activation chamber causes the tool piece to move to an inactive arrangement. The tool piece may be moved to an inactive arrangement under the action of a biasing means (e.g. against the action of the fluid in the activation chamber), or the forces inherently applied to the tool piece during use (e.g. the forces exerted on the cutter blade during a reaming operation).

Alternatively, the tool piece may be configured to move from an active arrangement to an inactive arrangement in response to the second piston moving to the open position. The tool may be configured such that the increase in pressure in the activation chamber causes the tool piece to move to an inactive arrangement. The inactive arrangement may correspond to the tool piece being withdrawn into the tool housing. The tool piece may be configured to move from an inactive to an active arrangement in response to the second piston moving to the closed position.

The tool may comprise a biasing assembly configured to bias the tool piece, or tool piece actuator towards an inactive position. The biasing assembly may be configured such that a biasing means exerts a biasing force on the tool piece and/or tool piece actuator when the first piston is in the first position. The biasing assembly may be configured such that a pressure gradient exerts a biasing force on the tool piece and/or tool piece actuator when the first piston is in the second position. The biasing assembly may be configured such that the wedges and/or tool piece actuator is not biased by the biasing assembly when the first piston is in the third position.

The tool according to the present disclosure may be a bypass tool or a reamer—for example a near-bit reamer or a string reamer.

The tool may be any tool with an active and inactive state or arrangement. The tool may be for use with circulation subs, stabilisers, or multiple configuration or position tools.

According to the disclosure is a downhole tool. The downhole tool may comprise a housing. The downhole tool may further comprise a first piston, which may be arranged within the housing such that it can move axially under the action of fluid flowing through the tool. The downhole tool may further comprise an indexer. The indexer may be configured to control axial movement of the first piston between a first, second and third axial position. The indexer may be configured such that the first piston can be selectively moved into the third position in accordance with a variation of a flow of fluid through the tool. The first piston may comprise a follower (which may be configured to engage the indexer) which may be configured to damp the movement of the first piston.

The features of this downhole tool may be in accordance with any of the above disclosure. Accordingly, comments made anywhere herein apply to the features of this downhole tool, mutatis mutandis.

According to the disclosure is a downhole tool. The downhole tool may comprise a housing. The downhole tool may further comprise a first piston, which may be arranged within the housing such that it can move axially under the action of fluid flowing through the tool. The downhole tool may further comprise an indexer. The indexer may be configured to control axial movement of the first piston between a first, second and third axial position. The indexer may be configured such that the first piston can be selectively moved into the third position in accordance with a variation of a flow of fluid through the tool.

The comments made anywhere herein apply to the features of this downhole tool, mutatis mutandis.

The indexer may be an indexer sleeve. The indexer may be arranged to rotate relative to the first piston and the housing. The tool may comprise a bearing arranged on the inner or outer radial surface of the indexer arranged such that the indexer is free to rotate relative to the housing, first piston or the mounting surface on which it is arranged. The indexer may define a pathway profile which may comprise a change in depth.

Further according to the disclosure is an assembly comprising a follower as described herein and an indexer as described herein. The follower may be independent from the first piston.

Further according to this disclosure is an indexer as described anywhere herein.

Further according to the disclosure is a downhole tubular, or a downhole tubular string, comprising a tool as described anywhere herein. The downhole tubular string may be a drill string.

Further according to the disclosure is a method for activating a tool, for example as described anywhere herein. The downhole tool may comprise a first piston. The downhole tool may further comprise an indexer configured to control axial movement of the first piston between a first, second and third axial position. The method may comprise moving the first piston into the third position by varying the flow of fluid through the tool, thus moving a second piston between a closed position in which fluid flowing through the tool is restricted from communicating with an activation chamber and an open position in which fluid flowing through the tool is permitted to communicate with the activation chamber.

The method may comprise varying the flow of fluid through the tool by undertaking a predetermined sequence of flow control actions.

BRIEF DESCRIPTION OF DRAWINGS

Examples of the present disclosure will now be described with reference to the figures below, in which.

DETAILED DESCRIPTION OF THE DISCLOSED EXEMPLARY EMBODIMENTS

Figure 1:
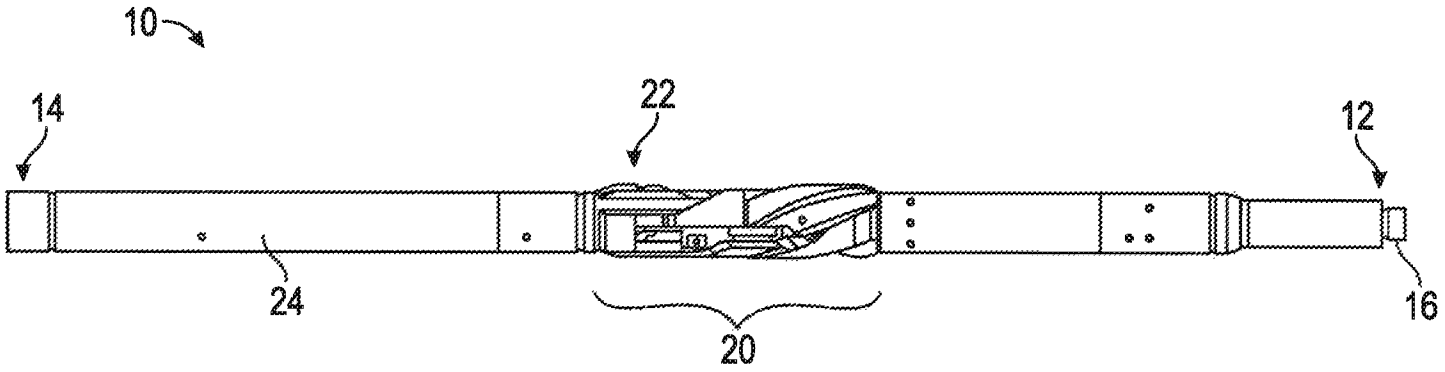
FIG. 1 is a side view of a tool according to the disclosure.
Figure 2:
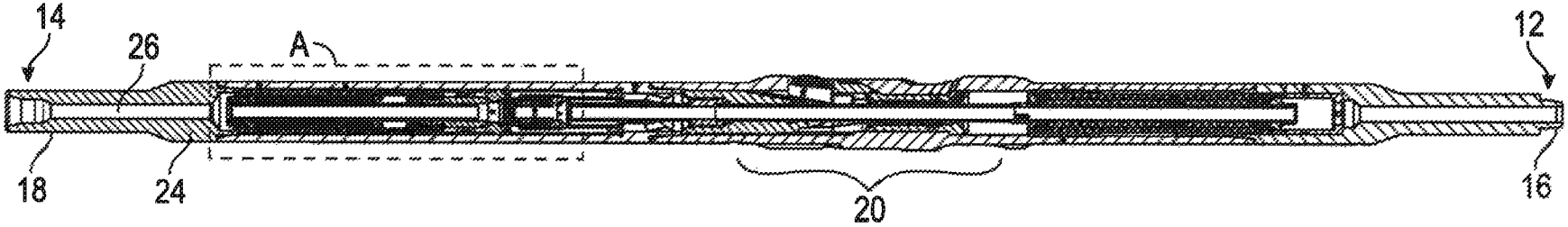
FIG. 2 is a cross-sectional view of the tool of FIG. 1.

FIGS. 1 and 2 depict a tool 10 according to the disclosure. FIG. 1 is a side view and FIG. 2 is a cross-sectional view.

The tool 10 of FIGS. 1 and 2 is a string reamer. The tool 10 comprises an elongated substantially cylindrical housing 24. The housing 24 comprises a plurality of sub-sections which are assembled to form the housing 24 as shown.

The tool 10 is for use in a downhole tubular string and comprises a first and second end 12, 14 for connection with tubulars on either side thereof. The first end 12 is shown in FIGS. 1 and 2 and comprises a male connector in the form of a pin connector 16. The second end 14 is shown in FIG. 2 only and comprises a female connector in the form of a box connector 18.

Towards the centre of the tool 10 as illustrated is a cutting section 20. The cutting section 20 comprises retractable cutter blades 22. In the arrangement shown in FIG. 1, the cutter blades 22 are in an inactive state, whereby they are retracted into the housing 24 of the tool 10.

As can be seen in FIG. 2, the tool 10 comprises a tool flow path 26 which extends along the length of the tool 10 along the central axis thereof. The tool flow path 26 is configured to allow drilling mud to flow through the tool 10 during drilling operations, such that it can reach the drill bit at the end of the drill string. The tool flow path 26 comprises a cylindrical hollow of substantially constant cross section through the length of the tool 10.

Figure 3:
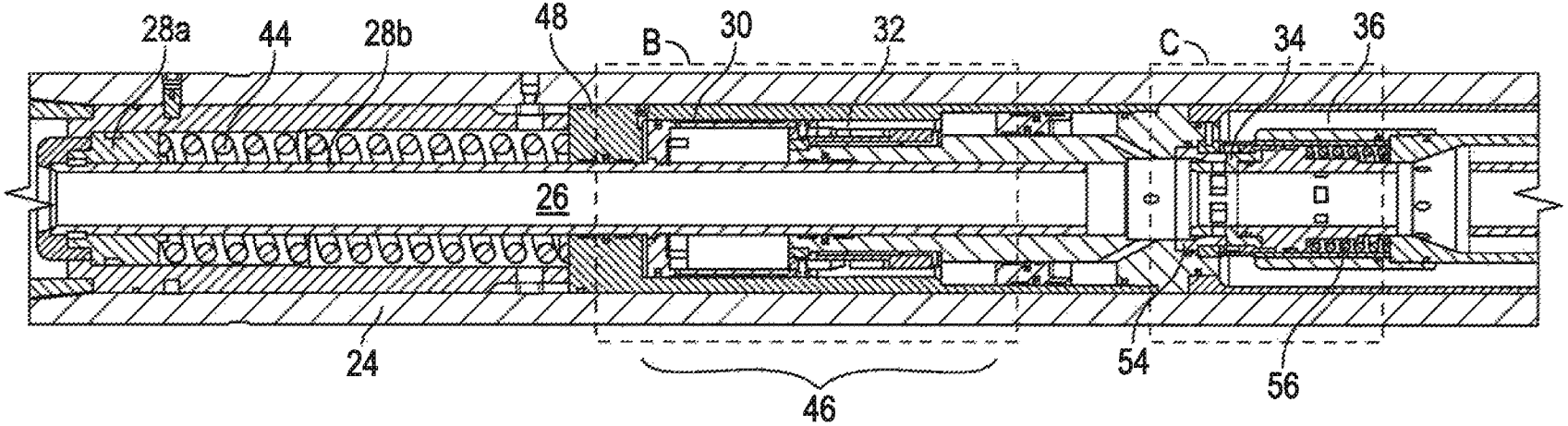
FIG. 3 is an enlarged view of part of FIG. 2.
Figure 4:
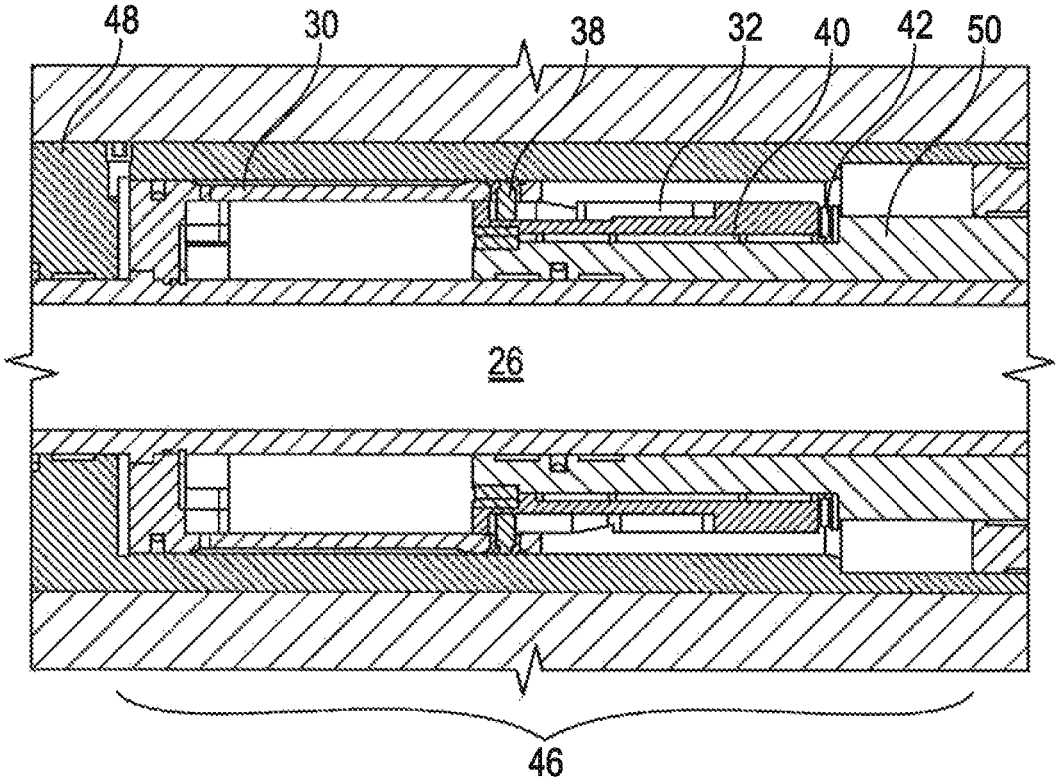
FIG. 4 is an enlarged view of part of FIG. 3.
Figure 5:
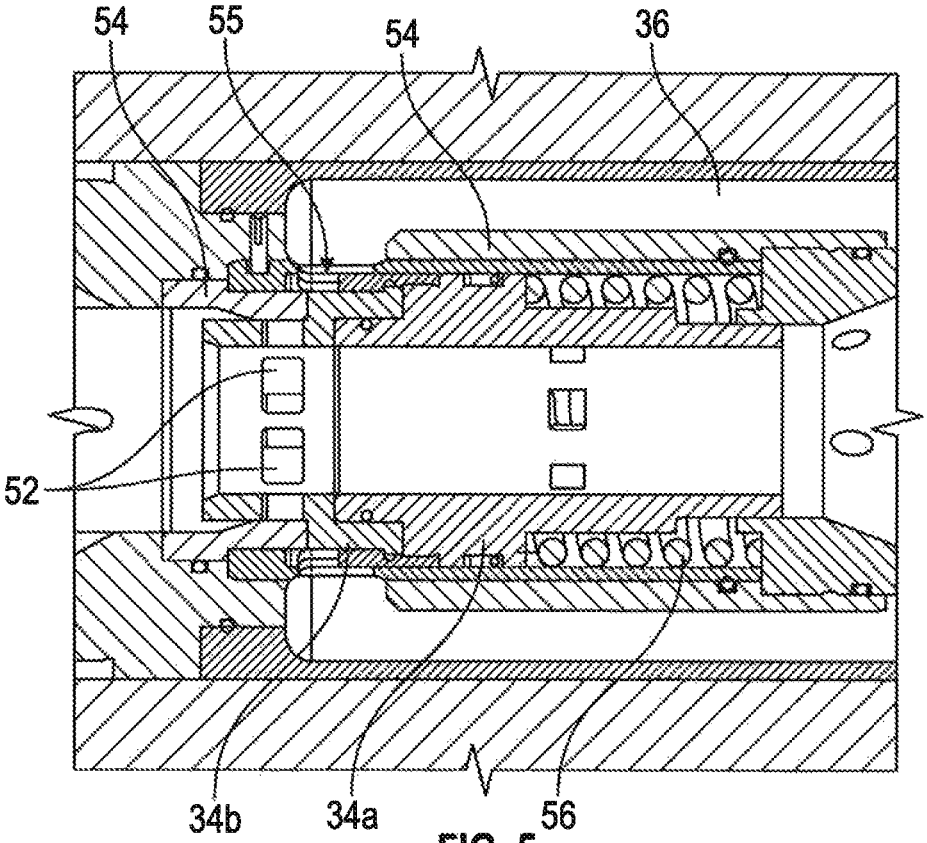
FIG. 5 is an enlarged view of part of FIG. 3.

FIG. 3 is a close-up of section A of the tool 10 as shown in FIG. 2. FIGS. 4 and 5 are enlarged views of FIG. 3. The following description is made with reference to FIGS. 3, 4 and 5.

The section of the tool 10 shown in FIG. 3 is configured to be selectively operable to move the cutter blades 22 between an active and inactive position.

The tool 10 comprises a first piston 28 arranged axially within the housing 24. The first piston 28 comprises a follower 30 which is fixed with respect to the first piston 28 and engages an indexer 32. The indexer 32 is configured to cooperate with the follower 30 and is configured to control axial movement of the first piston 28 between a first, second and third longitudinal position with respect to the housing 24. Towards the downhole end of the tool 10 (to the right in the figures) a second piston 34 is arranged adjacent an activation chamber 36. The second piston 34 is configured to move between a closed and an open position to restrict and permit fluid from communicating with the activation chamber 36, respectively. The fluid pressure in the activation chamber 36 is determined by whether fluid flowing through the tool flow path 26 can enter the activation chamber 36 which, in turn, is dependent on the position of the second piston 34. Increasing and decreasing the fluid pressure in the activation chamber 36 can move the cutter blades 22 between an active and inactive position.

The first piston 28 comprises a piston head 28*a* and a piston rod 28*b*. The piston head 28*a* and piston rod 28*b* both define part of the tool flow path 26 and, as such, fluid can flow through the centre of the first piston 28. The piston rod 28*b* of the first piston 28 extends through an annular support, the follower 30 and the indexer 32, towards the second piston 34.

The first piston 28 is configured such that it can move axially within the housing 24 in a first direction (to the right of FIG. 3) and a second direction (to the left of FIG. 3). The tool 10 comprises a first biasing means in the form of a first helical spring 44 which is arranged to bias the first piston 28 in the second direction—away from the second piston 34.

The follower 30 is fixed relative to the first piston 28. The follower 30 of the present example comprises a piston arranged to seal on an inner surface of a sleeve portion of an annular support 48. The follower 30 is arranged to move axially with the first piston 28. The follower 30 is arranged to move in a sealed chamber 46 defined by the housing 24 and the annular support 48. The chamber 46 contains oil and, as such, as the follower 30 moves within the chamber 46 the oil flows from one side of the follower 30 to the other. It should be noted, however, that fluids other than oil can be used for this purpose.

The follower 30 comprises a pin 38 which engages the indexer 32 and cooperates with paths of the indexer 32 to define the first, second and third position of the first piston 28.

It should be noted that in alternative examples, the locations of the indexer and pin may be reversed. That is, the part which is the follower in the present example may be the indexer such that it is fixed relative to the first piston 28. In such an example, the part which is the indexer in the tool of FIG. 1A may comprise a pin arranged to engage the indexer fixed relative to the first piston 28.

The indexer 32 is located adjacent and engaged with the follower 30, inside the chamber 46. The indexer 32 is a sleeve located radially-inwardly of a sleeve portion of the follower 30. The indexer 32 is mounted on an indexer support member 50. A bearing 40 located between the indexer 32 and the indexer support member 50 allows the indexer 32 to rotate relative to the housing 24. In the present example the bearing is a roller bearing, although it will be understood that any radial bearing will be suitable for such use. A thrust bearing 42 at the end of the indexer 32 axially restrains the indexer 32 while still permitting the indexer to rotate.

The second piston 34 comprises an assembly of a sealing part 34*a* and an activation chamber closing part 34*b*, as shown in FIG. 5. The second piston 34 is located in the first direction (downhole, in the present example) from the first piston 28. As with the first piston 28, the second piston 34 is configured with an internal bore such that it can form part of the tool flow path 26 to allow fluid flow therethrough.

Figure 8:
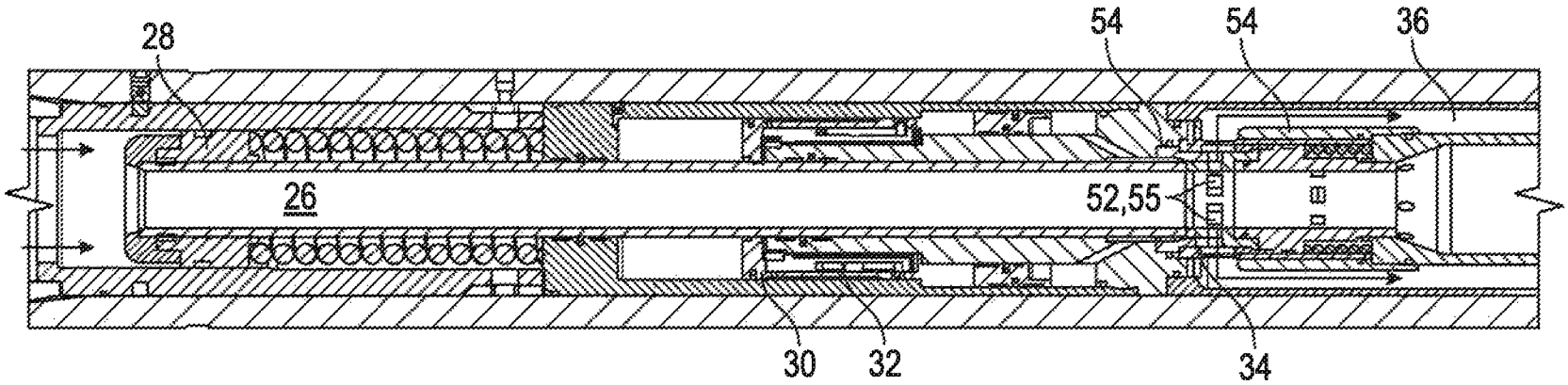
FIG. 8 is a cross-sectional view of the tool of FIG. 1, with the first piston in the third position.

The second piston 34 is arranged adjacent the activation chamber 36. A gate member 54 (which in the present example comprises an assembly of parts) surrounds the second piston 34 and defines a plurality of openings 55. The openings 55 in the gate member 54 provide access to the activation chamber 36. The second piston 34 comprises a series of radial ports 52 around the circumference of the second piston which are arranged to align with and communicate with the openings 55 in the gate member 54 when the second piston 34 is in an open position (as shown in FIG. 8). When the second piston 34 is in a closed position, as shown in FIGS. 2 to 6, the ports 52 are arranged adjacent a wall of the gate member 54, effectively shutting the ports 52 and restricting the flow of fluid into the activation chamber 36.

The tool 10 comprises a second biasing means in the form of a second helical spring 56 arranged to bias the second piston 34 towards the closed position—that is, in a second direction towards the first piston 28 in the present example.

Figure 6:
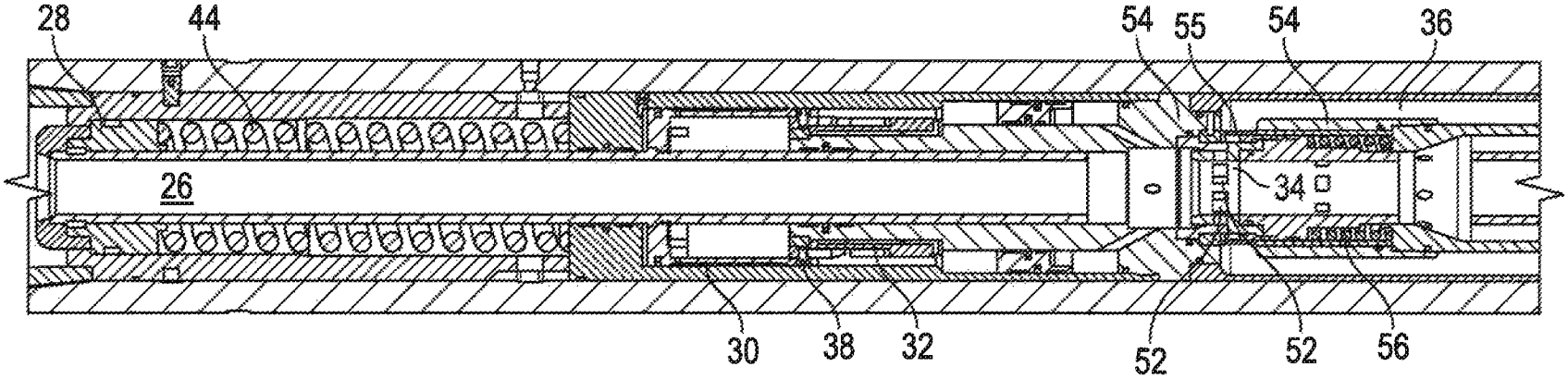
FIG. 6 is a cross-sectional view of the tool of FIG. 1, with the first piston in the first position.
Figure 7:
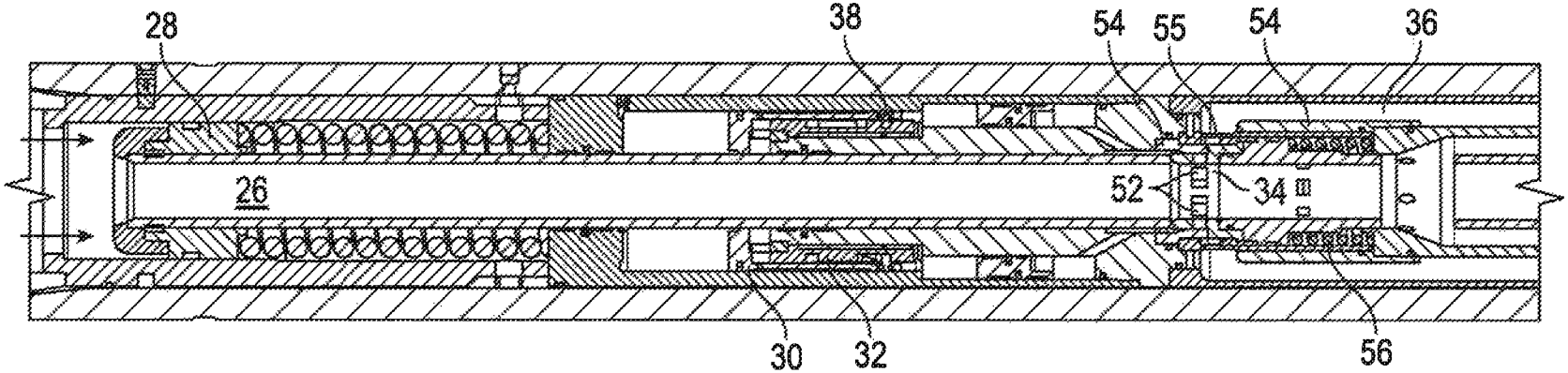
FIG. 7 is a cross-sectional view of the tool of FIG. 1, with the first piston in the second position.

FIGS. 6 to 8 depict the tool 10 with the first piston 28 in a first, second and third position, respectively.

FIG. 6 shows the tool with the first piston 28 in a first position. FIG. 7 shows the tool with the first piston 28 in the second position. FIG. 8 shows the tool with the first piston 28 in the third position. In FIG. 6, little or no fluid is flowing through the tool. In FIG. 7, fluid is flowing through the tool but the sequence of flow control actions required to move the first piston 28 to the third position have not been done. In FIG. 8, fluid is flowing through the tool and the sequence of flow control actions has been executed such that the first piston 28 can move to the third position.

In FIG. 6, the first piston 28 is in the first position, in an uphole position (i.e. as far in the second direction as the first piston 28 can go). The first piston 28 is urged in this direction by the first helical spring 44. The second piston 34 is in a closed position, which is also an uphole position (i.e. as far in the second direction as the second piston 34 can go). The second piston 34 is urged in this direction by the second helical spring 56. In the closed position, as shown in FIG. 6, the ports 52 of the second piston 34 are arranged adjacent a wall of the gate member 54. The second piston ports 52 are not in fluidic communication with the activation chamber 36.

The first piston 28 is in the first position when no fluid is flowing through the tool flow path 26.

Turning now to FIG. 7, the tool is depicted when fluid is flowing through the tool flow path 26. It can be seen that the piston has moved axially towards the second piston 34 (in the first direction—to the right of the figures) compared to the first position illustrated in FIG. 6. The first piston 28 is configured to move axially towards the second piston 34 under the action of fluid flowing through the tool. When fluid flows through the tool flow path 26, a pressure differential is provided across the first piston 28 (indicated by the arrows). This pressure differential exerts a force on the first piston 28, overcoming the biasing force and differential pressure from the tool flow path 26 to the activation chamber 36 provided by the first helical spring 44 and moving the first piston 28 towards the second piston 34.

The indexer 32 defines the first, second and third positions of the first piston 28 and, since the predetermined sequence of flow control actions has not been undertaken, the indexer 32 prevents the first piston 28 from entering the third position and instead restrains the first piston 28 at the second position via the pin 38 and follower 30, which engage the indexer 32 but are axially fixed relative to the first piston 28.

In the second position, the free end of the first piston rod 28*b* is adjacent the second piston 34, but has not fully engaged the second piston 34 so as to move the second piston 34 against the bias of the second helical spring 56. Accordingly, the ports 52 are still blocked by the wall of the gate member 54 and, accordingly, fluid flowing through the tool flow path 26 is restricted from entering the activation chamber 36. Differential pressure across the second piston 34 is also holding the second piston 34 in the closed position blocking the openings 55.

Turning now to FIG. 8, the tool is shown with the first piston 28 in the third position. In FIG. 8, it is assumed that fluid is flowing through the tool and the operator has undertaken the predetermined sequence of flow control actions defined by the indexer 32 such that the first piston 28 has entered the third position. In this position the first piston 28 has moved further axially towards the second piston 34 than in the second position.

The first piston 28 abuts the second piston 34 and urges the second piston 34 in the first direction (towards the right of FIGS. 6 to 8). The geometry of the first piston 28 and second piston 34, and the characteristics of the first and second helical springs 44, 56 have been selected such that, when fluid is flowing through the tool during use, the force axial force generated by the pressure gradient across the first piston 28 is sufficient to overcome the resistive forces of the first and second helical spring 44, 56 and any pressure forces acting on the second piston. As such, the first piston 28 moves the second piston 34 from the closed position (as shown in FIGS. 6 and 7) to the open arrangement.

When the second piston 34 is in the open arrangement, the ports 52 align with the openings 55 in the gate member 54 and fluid flowing through the tool can communicate with and enter the activation chamber 36 (as shown by the arrows in FIG. 8). The pressure in the activation chamber 36 therefore increases.

Figure 9A:
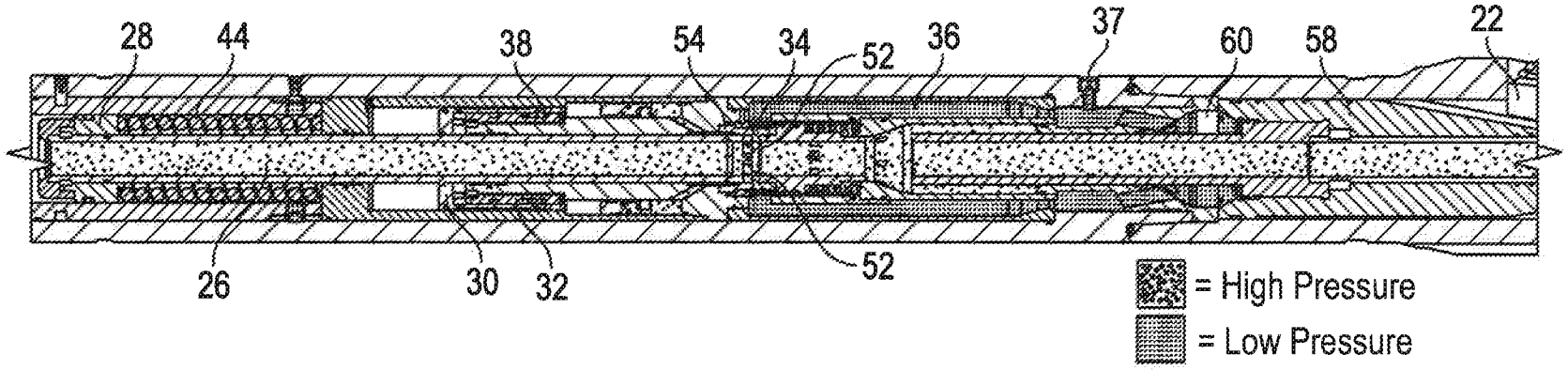
FIGS. 9A and 9B are cross-sectional views of the tool of FIG. 1 with the first piston in the second position.
Figure 9B:
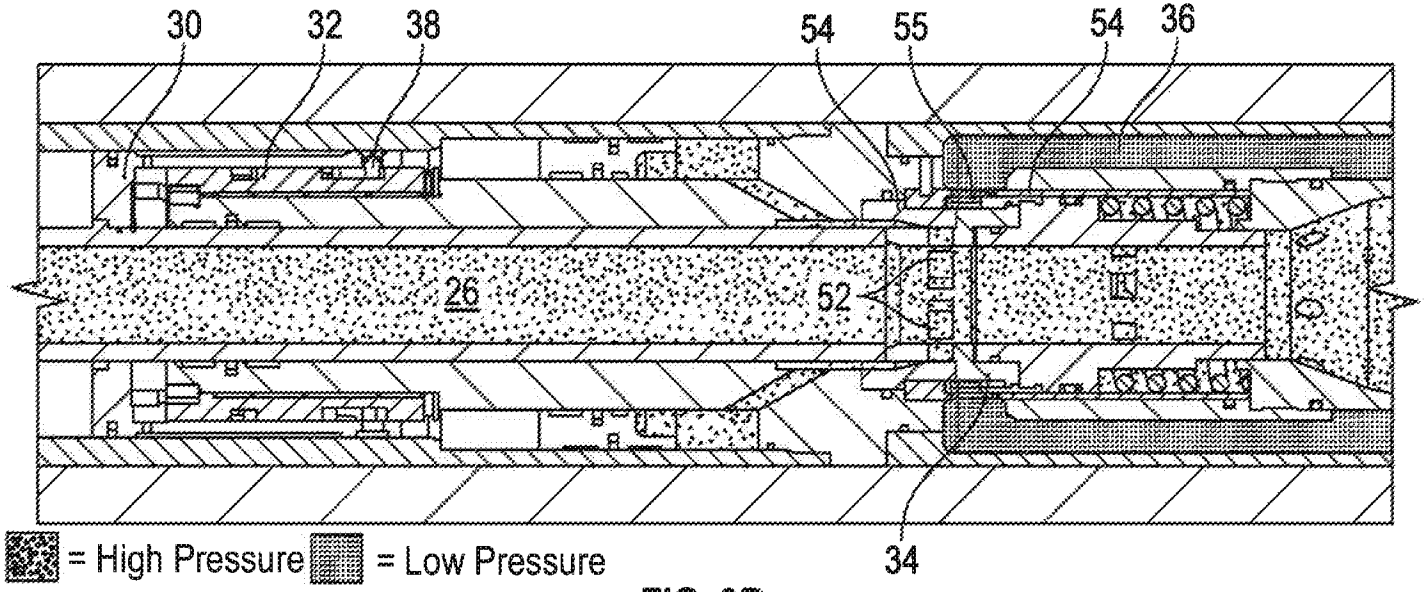

FIGS. 9A and 9B schematically illustrate the pressure of fluid within the tool 10 with the first piston 28 in a second position.

As can be seen in these figures, when the first piston 28 is in the second position fluid is flowing through the tool flow path 26 and the tool flow path 26 is at a comparatively high pressure.

The ports 52 of the second piston 34 are in a closed position and, as such, they are substantially closed by the gate member 54. Fluid in the activation chamber 36 is not exposed to the pressure of the fluid in the tool flow path 26. Accordingly, the fluid in the activation chamber 36 is comparatively low and the cutter blades 22 remain in an inactive (e.g. withdrawn) position.

Figure 9C:
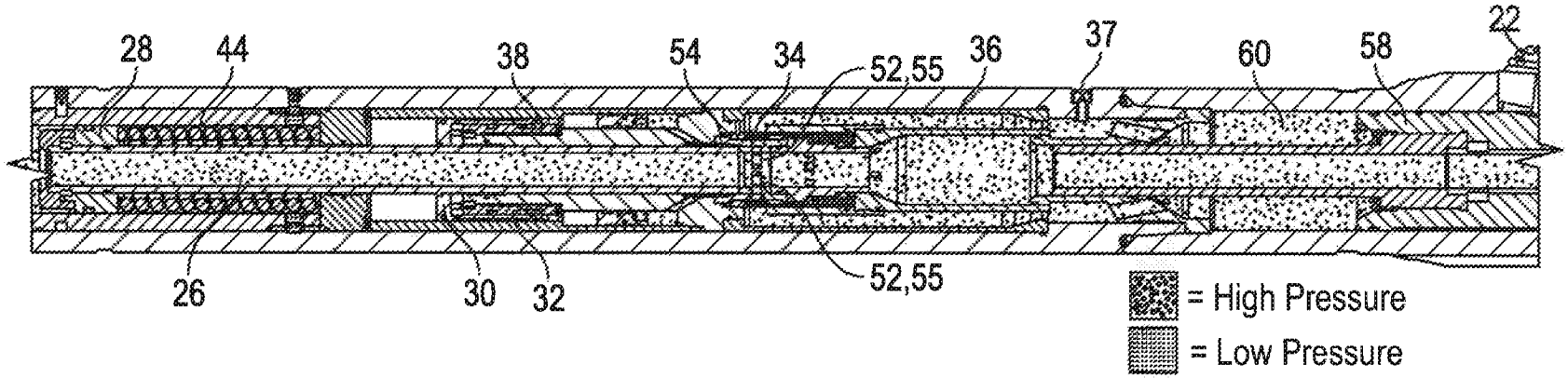
FIGS. 9C and 9D are cross-sectional views of the tool of FIG. 1 with the first piston in the third position.
Figure 9D:
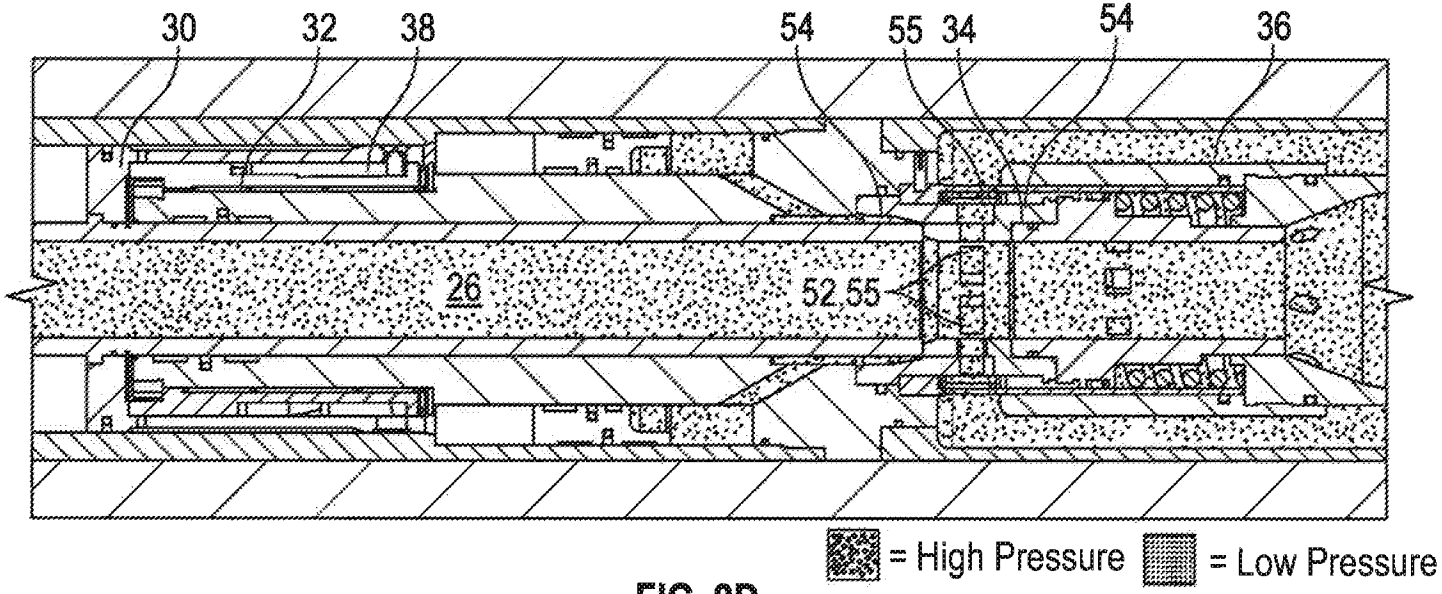

Turning now to FIGS. 9C and 9D, the first piston 28 is now in the third position. The ports 52 of the second piston 34 are now in an open position and are aligned with the openings 55 of the gate member 54 such that fluid from the tool flow path 26 communicates with, e.g. can freely flow into, the activation chamber 36. Fluid in the activation chamber 36 is therefore exposed to the pressure of the fluid in the tool flow path 26 and thus the activation chamber 36 pressure increases. The pressure in the activation chamber 36 therefore increases and becomes a high pressure zone, as illustrated in the figure.

When the first piston 28 is in the third position and the second piston is in an open position the pressure in the activation chamber 36 is greater than that of the annulus (i.e. in the gap between the tool 10 and the wellbore). The actual pressure of the activation chamber 36 may be determined by an outer flow restriction 37, connecting the activation chamber 36 to the annulus. The outer flow restriction 37 has a cross-sectional area which is much smaller than that of the ports 52 and the openings 55 such that the pressure in the activation chamber 36 is sufficiently high to move the cutter blades 22 to an active position.

The activation chamber 36 is fluidically connected to a pressure chamber 60. When the activation chamber 36 is at a high pressure as shown in FIG. 9B, the pressure chamber exerts an axial force on a plurality of tool piece actuators in the form of wedges 58. The force caused by the fluid pressure overcomes a biasing force acting on the wedges 58 and cutter blades 22 (discuss in more detail later), and the wedges 58 move axially in a first direction (i.e. to the right—downhole in the present example). An angled face of each wedge 58 engages a cutter blade 22, causing the cutter blade 22 to extend radially outwardly from the housing 24, from an inactive position (FIG. 9A) to an active position (FIG. 9B).

Figure 10:
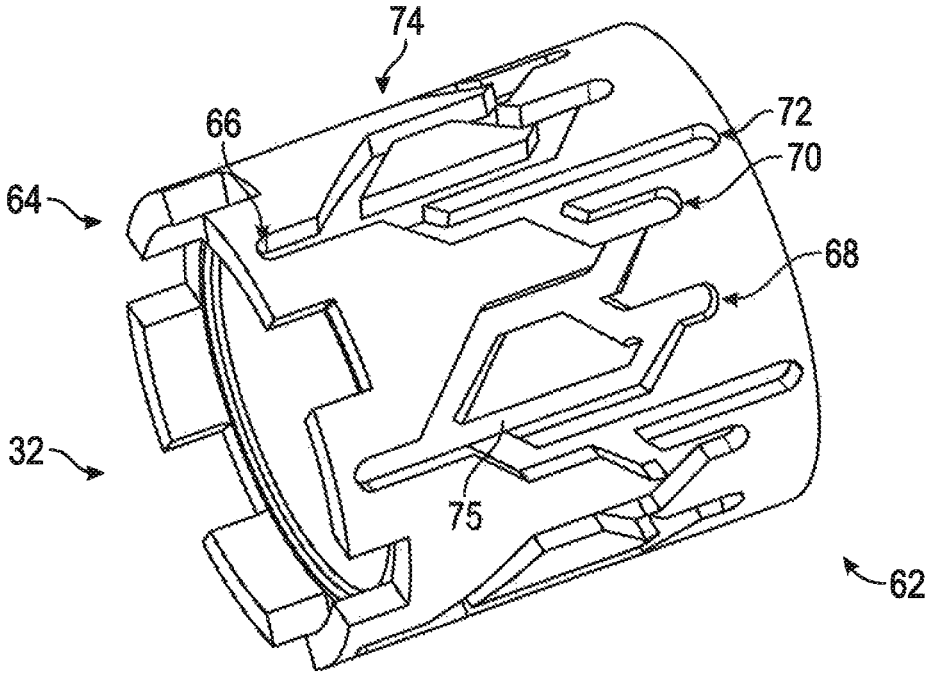
FIG. 10 is a perspective view of an indexer according to the disclosure.

FIG. 10 depicts an indexer 32 according to the disclosure.

The indexer 32 is tubular and is thus an indexer sleeve. The indexer 32 comprises an internal radius configured to be mounted on roller bearings surrounding a cylindrical mounting surface within the housing, such that the indexer can rotate relative to the housing. A first end 62 of the indexer 32 comprises a flat surface which is arranged to engage a thrust bearing located between the first end 62 of the indexer 32 and the housing 24, or a support fixed with respect to the housing 24. The indexer 32 is therefore configured to rotate relative to the housing 24 but is axially restrained such that it cannot move in the first direction with respect to the housing 24.

A second end 64 comprises a castellated profile. The castellated profile may be configured to engage a similarly castellated profile on the inside of the follower 30 (discussed in more detail below) to support axial loads when the first piston is in the second and third positions.

On the outer curved surface of the indexer 32 a pathway profile 74 comprising a plurality of paths is defined in the form of channels cut into the thickness of the indexer sleeve. The channels are arranged to mate with the follower pin 38. The paths cooperate with the pin 38 of the follower 30 to define the first position, second position and third position of the first piston 28. The paths comprise corresponding locations for the pin 38 when the first piston is in the first position 66, second position 68 and the third position 72.

In the example shown, the paths also comprise a location for the pin 38 which define an intermediate position 70 of the first piston 28, to be entered between the second position and the third position. When in the intermediate position, the first piston is at the same axial position as the second position (i.e. the second piston has not been urged to move between the closed and open position). The provision of an intermediate position for the first piston 28 increases the length of the sequence of flow control actions required to enter the third position and, as such, reduces the likelihood that the first piston 28 will enter the third position by mistake.

The indexer 32 and pin 38 are configured such that the pin 38 can travel along the paths as the first piston 28 moves axially within the housing 24. The indexer 32 is configured to rotate relative to the first piston 28 as the pin 38 traverses a path which extends circumferentially around the indexer 32.

The pathway profile 74 comprises a change in depth in the form of a step 75. The step 75 is located at a position to prevent a pin 38, following the paths defined by the pathway profile 74 from entering the paths in an incorrect sequence and hence going straight from the first position to an intermediate position or the third position without first going to the second position. The step is discussed further with reference to FIG. 11.

Figure 11:
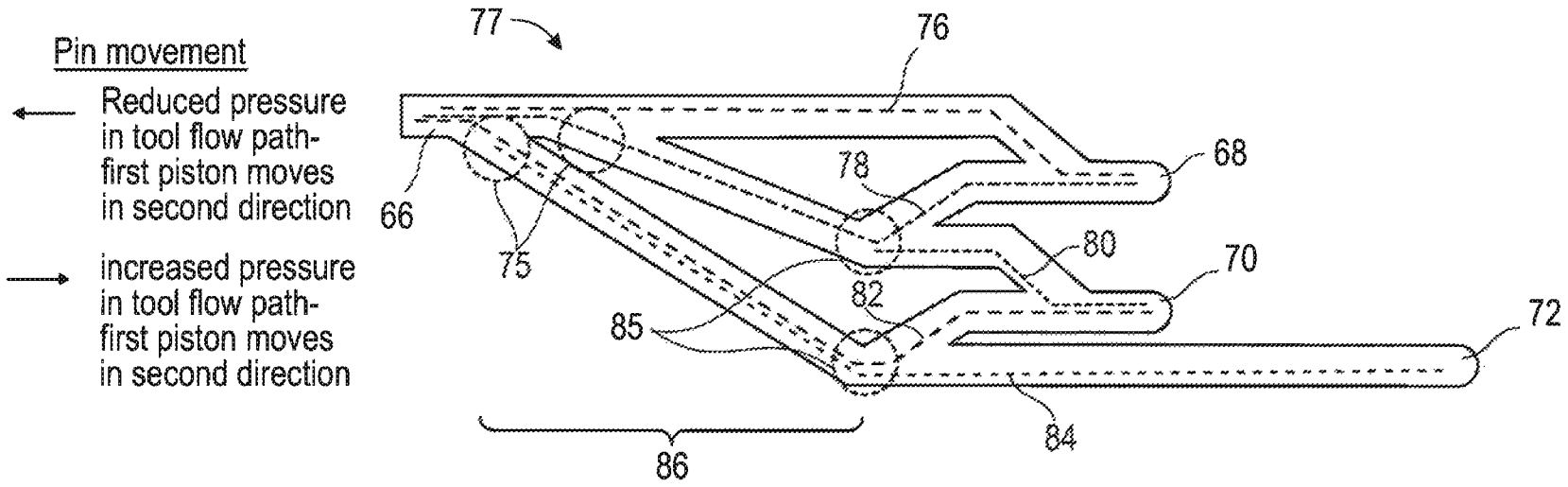
FIG. 11 is a schematic illustration of a pathway arrangement suitable for use with an indexer according to the disclosure.

FIG. 11 schematically illustrates an example pathway profile 77 for use on an indexer 32 according to the disclosure. The pathway profile 77 of FIG. 11 and FIG. 12 is similar, but slightly different, to that shown in FIG. 10. The function of both pathway profiles 74, 77 however, are essentially the same—that is, both profiles define a first, second and third position of the first piston. Both pathway profiles 74, 77 are suitable for use in a tool 10 according to the disclosure.

The pathway profile 77 includes a position for the pin 38 when the first piston 28 is in the first position 66, second position 68, an intermediate position 70 and the third position 72.

The pathway profile 77 comprises a first path 76 along which the pin 38 may travel when the first piston 28 moves axially towards the second piston 34 in response to fluid flowing through the tool 10, thus producing a pressure differential across the first piston 28. The first path 76 guides the first piston 28 from the first position to the second position.

If the pressure across the first piston 28 is reduced, for example because the flow through the tool flow path 26 has been reduced, the first piston 28 moves in the second direction and the pin 38 traverses the second path 78, which leads from the pin location for the second position 68 to that for the first position 66.

If the pressure in the tool flow path 26 remains low, the first piston 28 reaches the first position and the pin 38 reaches the corresponding location for the first position 66.

If, however, during the return stroke—i.e. as the first piston 28 moves from the second position towards the first position and the pin moves from the corresponding location for the second position 68 towards that for the first position 66—the pressure in the tool flow path 26 again increases, the first piston 28 moves back in the first direction. The pin 38 will therefore follow the first intermediate path 80, which branches off from the second path 78 and leads to a pin location corresponding to the intermediate position 70.

In the intermediate position the first piston is at the same axial location as in the second position and as such, the arrangement of tool is as shown in FIGS. 7 and 9A.

When the pressure in the tool 10 is again reduced, the first piston 28 moves in the second direction again and the pin 38 follows the second intermediate path 82 towards the location for the first position 66.

If the pressure in the tool flow path 26 remains low, the first piston 28 reaches the first position and the pin 38 reaches the corresponding location for the first position 66.

If, however, the pressure in the tool flow path 26 is again increased before the first piston 28 reaches the first position (and hence before the pin 38 reaches the corresponding location 66), the first piston 26 again moves in the first direction and the pin 38 follows the third path 84. The third path 84 leads the corresponding pin location for the third position 72. Accordingly, the first piston enters the third position.

The time during which the flow rate can be increased to enter the 'next' path (e.g. the first intermediate path 80 from the second path 78, or the third path 84 from the second intermediate path 82) is determined by the location of the intersections 85. The intersections 85 are configured such that once the pin 38 is located at, or has traversed, the intersection 85, reversal of the movement of the pin 38 results in the pin 38 entering the next path rather than the one from which it came. Therefore, the pin 38 must have traversed, or be located at, the intersection 85 before the flow rate is increased in order for the pin 38 to enter the 'next' path. The time that it takes for the pin 38 to travel from the location corresponding to the second position 68 (or intermediate position 70) to the intersection 85 may be referred to as a "predetermined period".

Once the pin 38 has traversed the intersections the first piston will not be able to advance to the 'next' position, even if the flow rate is again increased. Instead, the first piston 28 will go to the first position. The section in which this is the case extends between the intersections 75 and the location corresponding to the first position 66.

Given knowledge of the characteristics of the tool 10, the time that it takes for the pin 38 to move from the location corresponding to the second position 68 (or intermediate position 70) to the intersection 85 may be calculated. Alternatively, it may be measured.

Likewise, the time it takes for the first piston 28 to travel from the second position to the first position can be calculated or measured.

These two times will allow a user to determine a window of time after reducing the flow through the tool during which the flow needs to be increased in order to move the first piston 28 into the 'next' position (e.g. intermediate position or third position). This window of time is schematically represented in FIG. 11 by reference numeral 86.

Although not visible in FIG. 11, the location of the change in depth of the paths—i.e. steps 75—are indicated. A first step 75 is located at the intersection between the first path 76 and the second path 78 at the end closest to that corresponding to the first position 66. A second step 75 is located at the end of the third path 84 and second intermediate path 82 at the end closest to the location corresponding to the first position 66. The steps 75 are defined as a step down when travelling along the second path 78 or third path 84 towards the location corresponding to the first position 66 of the piston 68. The steps 75 are arranged to prevent a pin from inadvertently entering the second path 78 or third path 84 from the first path 76, without first going to the location corresponding to the second position 68. This prevents the tool 10 from inadvertently going straight from no-flow to the third position, activating the tool, unintentionally.

As can be seen from the schematic pathway profile 77, the third position corresponds to an axial location of the first piston further towards the second piston (i.e. in the first direction) than the second and intermediate positions.

Turning now to FIGS. 12A to 12K a movement sequence of the pin 38 in the pathway profile 77 of FIG. 11 is shown.

Figure 12B:
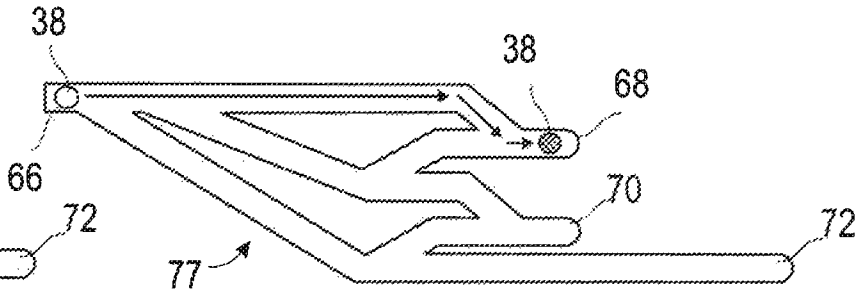
FIGS. 12A to 12K are schematic illustrations of the movement sequences of a pin in a pathway according to FIG. 11.
Figure 12D:
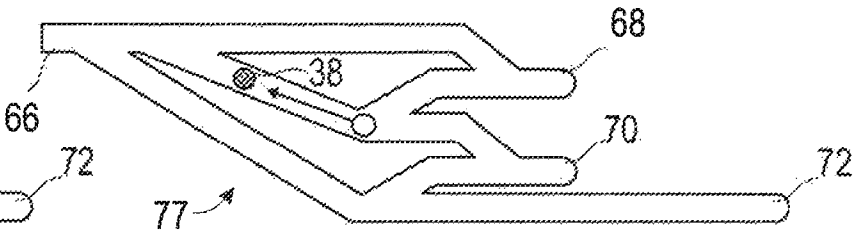
Figure 12A:
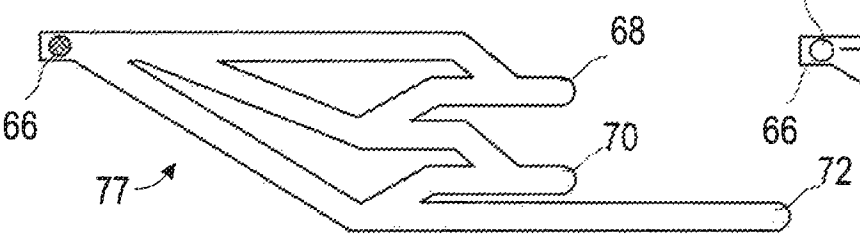

In FIG. 12A the pin 38 is at the location corresponding to the first position 66 of the first piston 28.

In FIG. 12B, the pin 38 is shown moving from the location corresponding to the first position 66 to that of the second position 68 along the first path 76. This movement is caused by fluid starting to flow through the tool 10, thus introducing a pressure differential across the first piston 28 and moving the first piston 28 to the second position.

Figure 12C:
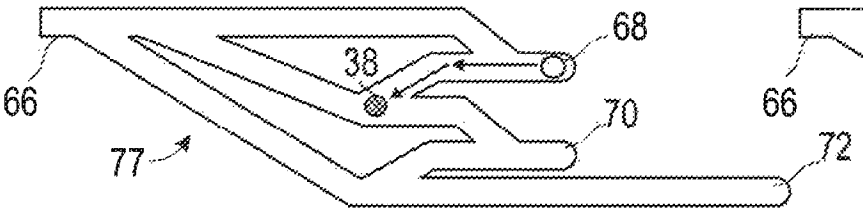

In FIG. 12C, the flow of fluid through the tool 10 has been reduced causing the first piston 28 to be urged towards the first position by the first helical spring 44. The pin 38 therefore travels towards the location corresponding to the first position 66 along the second path 78.

Figure 12E:
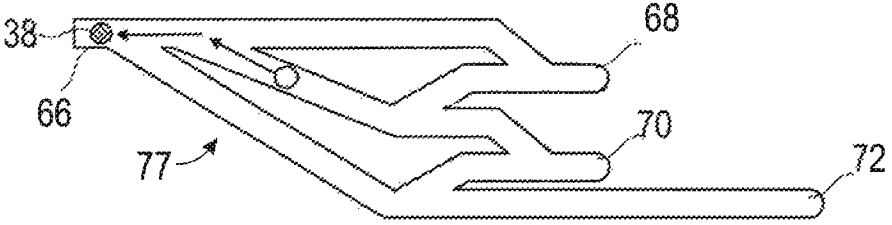

In FIG. 12D the pin 38 continues along the second path 78, until it reaches the location corresponding to the first position 66 of the first piston 28, in FIG. 12E.

Figure 12F:
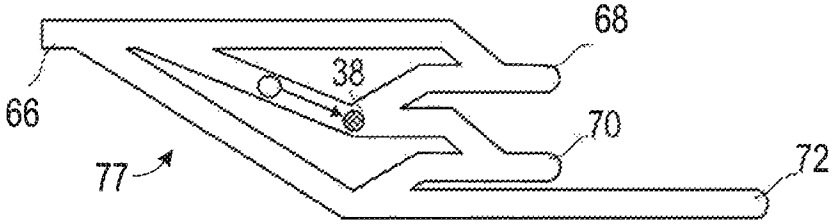

In FIG. 12F, movement is shown corresponding to a movement of the first piston 28 towards the second piston 34 occurring after the period shown in FIG. 12D but before the period shown in FIG. 12E. That is, the flow rate through the tool 10 is increased during the transition from the first position to the second position (i.e. at some point while the pin 38 is traversing the second path 78). FIG. 12F shows the pin moving up the second path 78, towards the intermediate position 70.

Figure 12G:
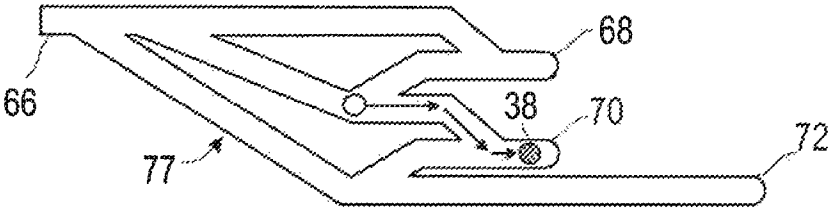

In FIG. 12G, the flow rate is maintained and so the pin 38 continues to travel to the intermediate position 70, via the first intermediate path 80.

Figure 12H:
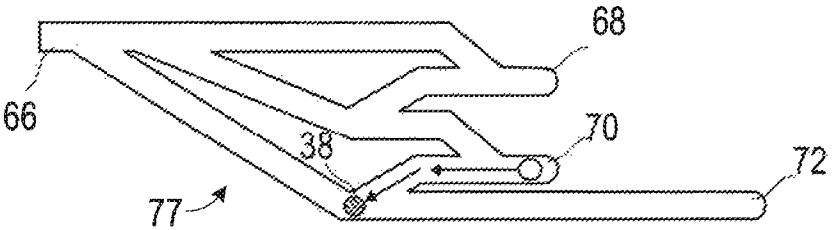

In FIG. 12H, the flow rate through the tool 10 is reduced such that the first piston 28 is biased in the second direction and the pin 38 moves along the second intermediate path 82 towards the location corresponding to the first position 66.

Figure 12I:
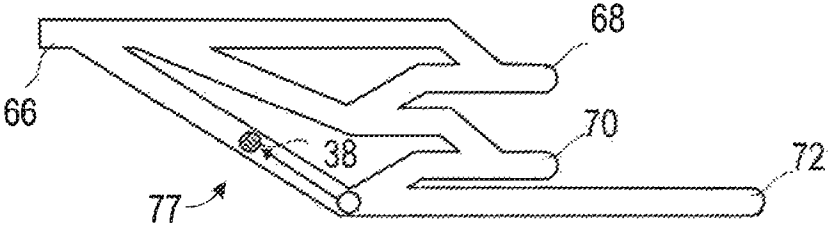
Figure 12J:
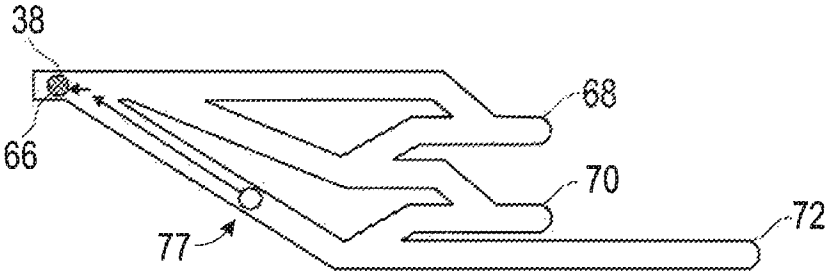

In FIGS. 12I and 12J the flow rate is maintained at a low level (e.g. off) and the first piston 28 continues to move in the second direction and the pin 38 therefore travels along the second intermediate path 82 to the location corresponding to the first position 66.

Figure 12K:
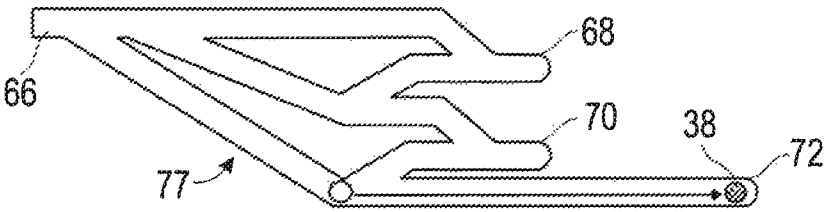

In FIG. 12K, however, the flow rate through the tool 10 is increased before the first piston reaches the first position (and hence before the pin 38 reaches the corresponding location 66). The first piston 28 is therefore moved in a first direction and moves to the third position; the pin follows the third path 84 and moves to the location corresponding to the third position 72. The flow rate is increased at a time after the period shown in FIG. 12H but before that shown in FIGS. 12I and 12J (although it is to be noted that the first piston 28 would still enter the third position if the flow rate was increased after the period shown in 12I but before that of 12J).

FIGS. 13A to 13D depict an assembly of the follower 30 and indexer 32 in configurations corresponding to the first piston 28 being in the first position, second piston, an intermediate position and the third position.

The follower 30 has six pins 38 equally spaced around the circumference of the sleeve portion of the follower 30 which engage the pathway profile of the indexer 32. The pathway profile defines ramps 79 which provide a change in depth of the corresponding path. Ramps 79 are located in the first path, leading from the location first position to the second position, and the path leading from the third position back to the first position. The ramps 79 are provided such that step 75 can be included and the pathway profile can still provide a continuous pathway profile around the indexer 32.

Figure 13A:
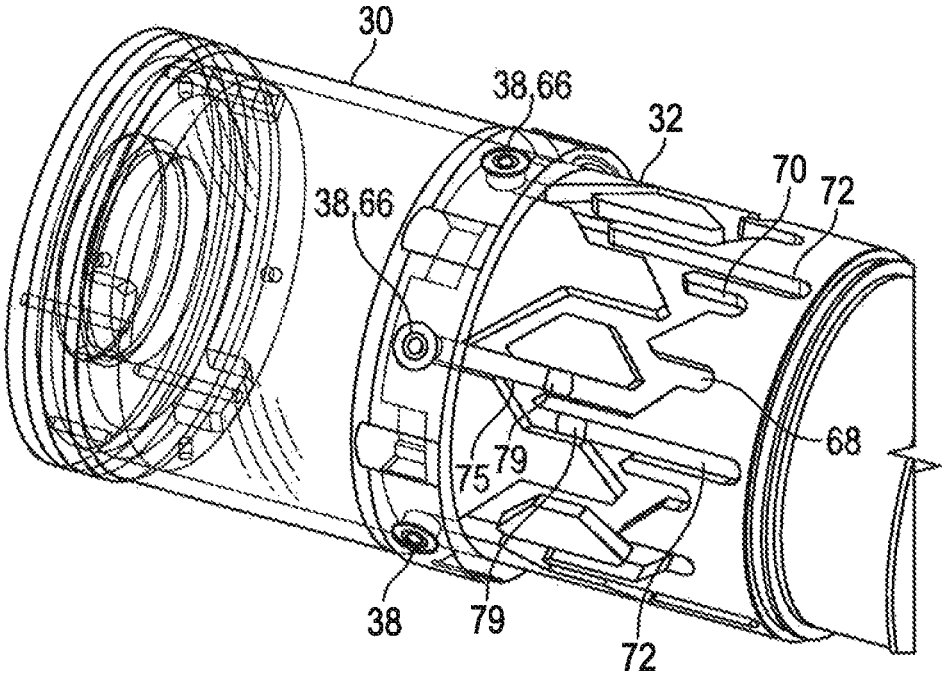
FIGS. 13A to 13D a illustrative views of a follower and indexer assembly for use in the tool of FIG. 1.

In FIG. 13A, the pins 38 are located in a position corresponding to the first piston 28 being in the first position 66.

Figure 13B:
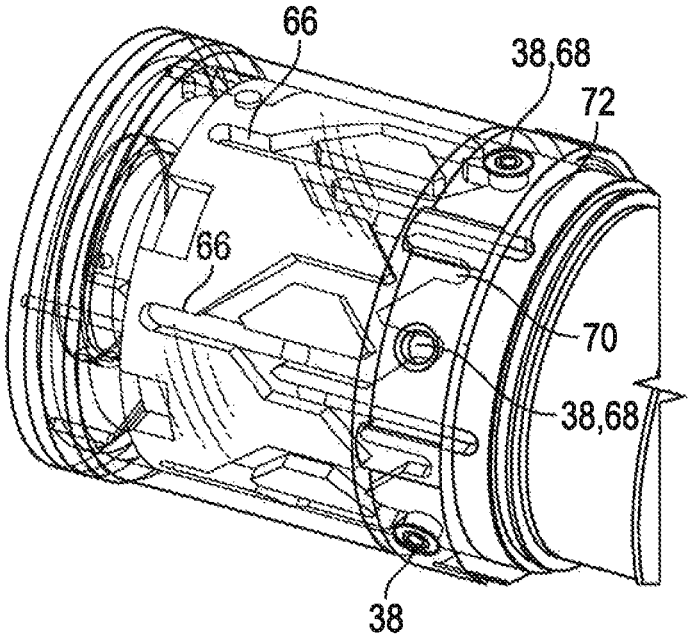

In FIG. 13B the first piston 28 has moved to the second position and the pin 38 has advanced to the corresponding second position 68. The follower 30 has moved axially, the indexer 32 has rotated relative to the housing 24 and follower 30.

Figure 13C:
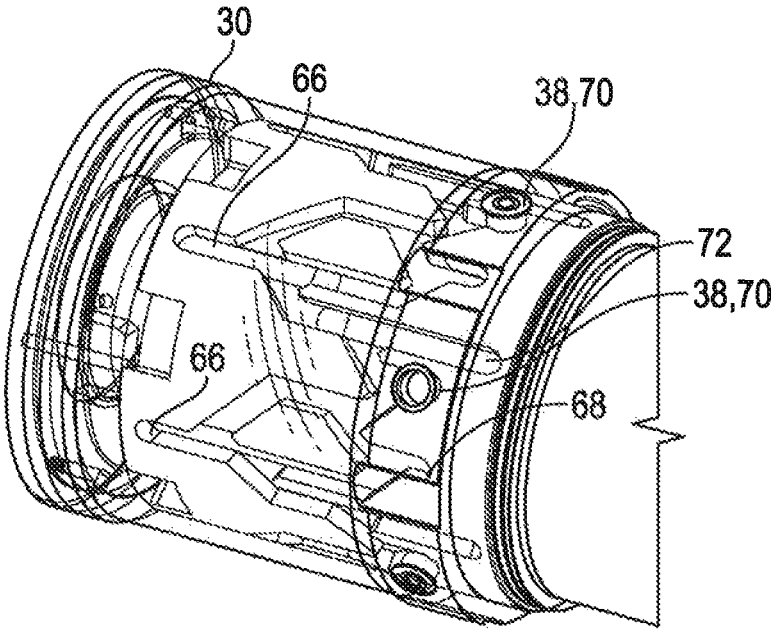

In FIG. 13C the pin 38 is in an intermediate position 70. Accordingly, the flow through the tool 10 has been reduced and then increased before the first piston 28 reached the first position. Again, the follower 30 has moved axially while the indexer 32 rotates.

Figure 13D:
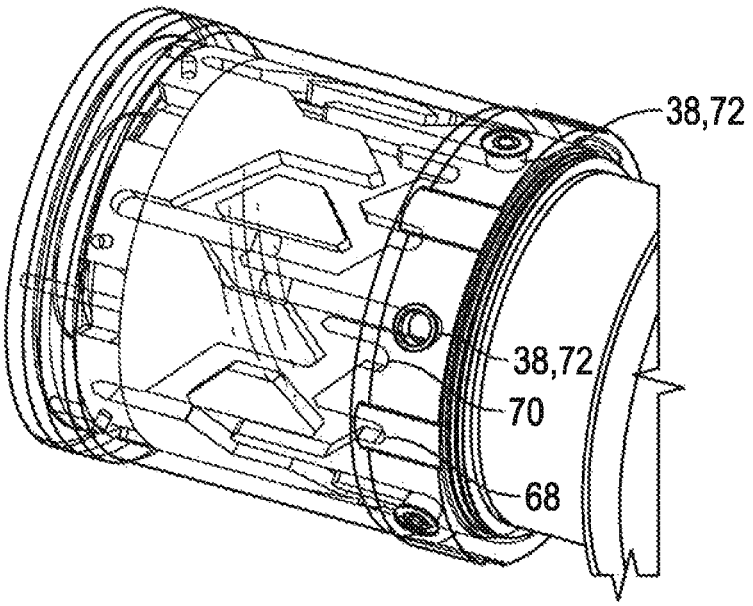

In FIG. 13D the first piston 28 is in the third position and the pin 38 is in the corresponding position.

Figure 14:
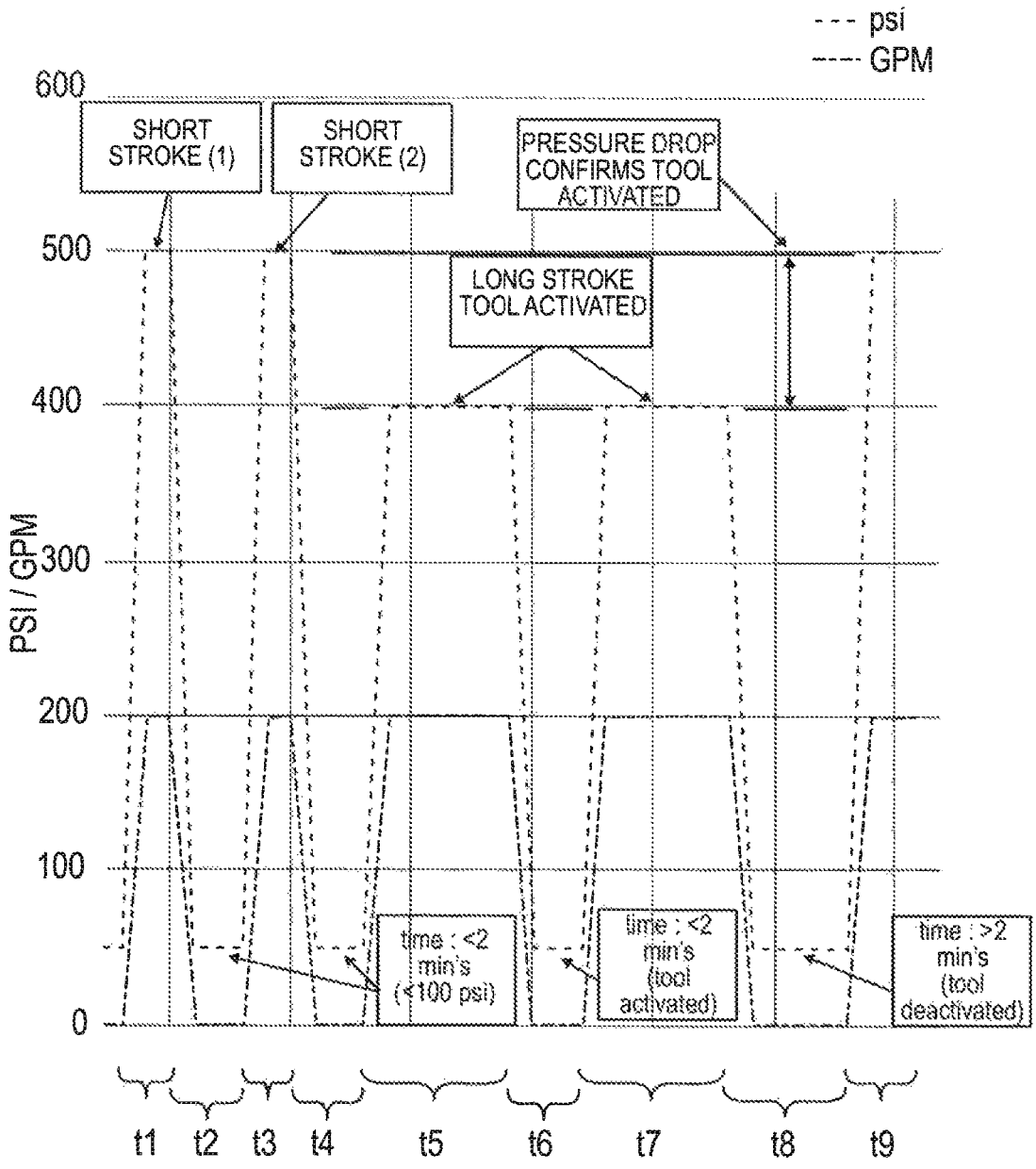
FIG. 14 is a graph schematically illustrating an example of the pressure of the fluid flowing through a tool according to the disclosure.

FIG. 14 is a graph showing an exemplar sequence of flow control actions for use with a tool according to the disclosure. In the tool according to the graph of FIG. 14, the indexer 32 comprises a pathway profile including an intermediate position. As such, two cycles of a reducing in pressure shortly followed by an increase in pressure are required in order for the first piston 28 to move to the third position to activate the tool. In this example, the predetermined time period (i.e. the time period during which the flow rate must be increased for the first piston to move to the 'next' position) has been calculated or measured at 2 minutes.

The tool starts with little or no fluid flowing therethrough. Thus the first piston is in the first position. During the time period t1 the flow rate is increased and thus the pressure increases causing the piston to move into the second position 68. In t2 the flow rate is reduced and the pressure drops. Before the first piston 28 reaches the first position, however, the flow rate is increased at the start of t3—this moves the piston to the intermediate position 70. The flow rate is again reduced and the pressure drops during t4. Before the first piston reaches the first position, the flow rate is again increased and the pressure rises during t5. This causes the first piston to move to the third position (t5), activating the tool.

Time periods t6 and t7 illustrate that the flow rate can be reduced and provided it is increased within the predetermined time period (2 minutes in the present example) ensuring that the first piston 28 does not reach the first position, the first piston will go back to the third position. In t6 the flow rate is reduced such that the first piston 28 leaves the third position and the tool is deactivated. However, the flow rate is increased before the first piston 28 reaches the first position and, as such, the first piston 28 moves back to the third position, reactivating the tool (t7).

In time period t8 the flow rate is reduced for longer than the predetermined time period such that the first piston 28 reaches the first position. Accordingly, when the flow rate is again increased in period t9, the first piston 28 moves to the second position and the tool fails to reactivate immediately, unlike in time period t7.

The graph of FIG. 14 also illustrates that there is a drop in the peak pressure of the fluid flowing through the tool when the first piston 28 is in the third position. This allows a user to easily and reliably confirm from the surface whether the tool is in an active or inactive position.

Figure 15:
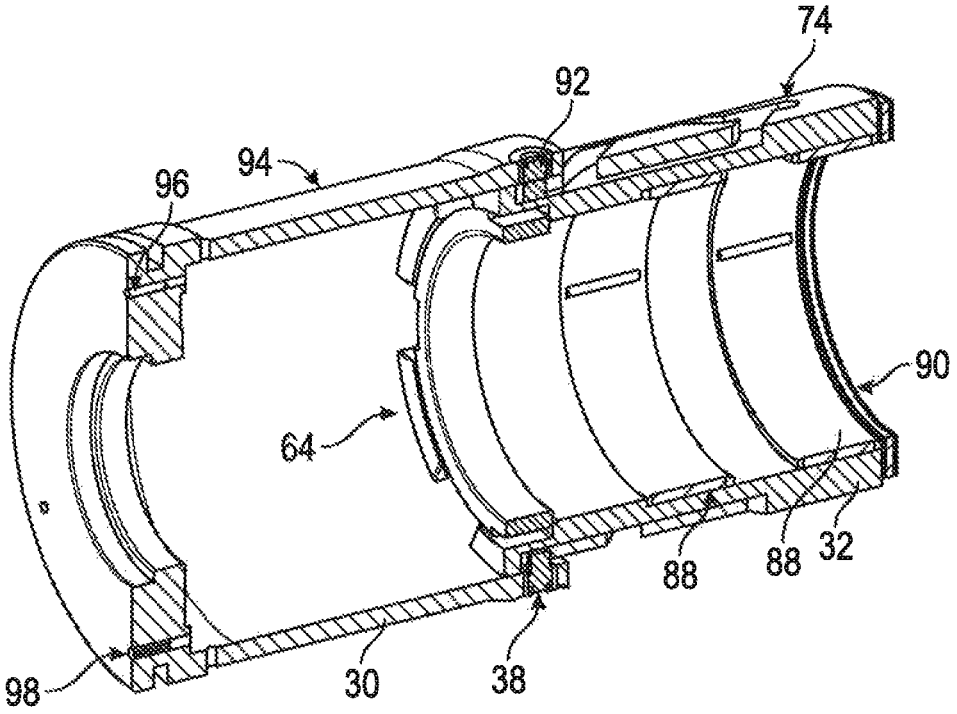
FIG. 15 is a perspective cross-sectional view of an indexer according to the present disclosure engaged with a follower.

FIG. 15 illustrates an assembly of a follower 30 and an indexer 32 according to the disclosure.

The indexer 32 comprises is as described with reference to FIG. 10. The assembly includes a pair of needle roller bearing 88 and needle thrust bearing 90 on the inner circumferential surface and first end 62 of the indexer 32. The bearings 88, 90 allow the indexer 32 to rotate relative to the housing 24 or cylindrical support member 100 (see FIG. 16) on which it is mounted.

The indexer 32 comprises a plurality of sets of identical pathway profiles which repeat around the circumference of the indexer 32. In the present example there are six sets of identical pathway profiles repeated around the outer surface of the indexer 32.

The second end 64 of the indexer 32 comprises a castellated profile, as discussed above. The end profile of the second end 64 is configured to be complementary to, and engage, a corresponding profile on a surface of the follower 30 such that the axial load is transferred between the follower 30 and the indexer 32 via the castellated profile rather than the pin 38. Accordingly, a first set of surfaces of the second end 64 of the indexer 32 and of the follower 30 are arranged to abut when the first piston 28 is in a second position. A further set of surfaces of the second end 64 of the indexer 32 and of the follower 30 are arranged to abut when the first piston 28 is in an intermediate position. A further set of surfaces of the second end 64 of the indexer 32 and of the follower 30 are arranged to abut when the first piston 28 is in the third position.

The follower 30 is arranged to seal with a tubular member in which it is located, for example the housing 24. The follower comprises a sleeve section 94 which is arranged to surround the indexer 32 when the first piston 28 is in the third position. The follower 30 and indexer 32 are therefore arranged such that the indexer 32 can move into and out of the follower 30 as the first piston moves between the first, second and third positions.

The follower 30 comprises six pins 38 arranged around the internal circumference of the sleeve section 94 to engage the channels of the six sets of pathway profiles 74 of the indexer 32. The follower 32 comprises a wave spring 92 arranged to bias each pin 38 away from the follower 32, into the path/pathway profile 74 of the indexer 32.

The wave spring 92 biases the pin 38 towards the bottom of the corresponding path. This ensures that, if the pin 38 encounters a step 75 arranged in the pathway profile 74, it does not inadvertently traverse the step 75 due to a poor contact between the path and the pin 38. The wave spring 92 ensures the pin 38 is always in contact with the bottom of the path such that the step 75 efficiently prevents the pin 38 from entering the corresponding path.

As discussed previously, the pathway profile 74 comprises ramps in order to return the pin 38 to the 'correct' height after traversing a step 75, these are seen in FIG. 13A. This ensures a continuous pathway profile 74 can be provided.

The follower 30 and indexer 32 are arranged within a sealed chamber containing fluid. The follower 30 provides a seal with support 48 (shown in FIG. 3). The indexer 32 is axially fixed within the housing 24. As the follower 30 moves axially with the first piston 28, fluid within the chamber moves from one side of the follower 30 to the other. The follower 30 comprises a flow control valve 96 and a check valve 98 for defining a restricting to fluid flow in both directions. However, in other examples the check valve 98 may be omitted and the fluid may flow through just the control valve 96 in both directions. Alternatively, the control valve 96 and check valve 98 may be replaced with a high bulk modulus oil (e.g. silicone oil) flowing through a flow restriction defined by the follower 30.

The check valve 98 is configured such that, when the follower 30 is moving in a first direction (i.e. the first piston 28 is moving towards the second position and the second piston 34), the check valve 98 permits fluid flow therethrough. The check valve 98 is configured such that, when the follower 30 is moving in a second direction (i.e. the first piston 28 is moving towards the first position and away from the second piston 34), the check valve 98 restricts fluid flow therethrough. Accordingly, the overall restriction to fluid flow defined by the follower 30 is greater when the follower 30 (and hence first piston 28) is moving in a second direction (i.e. towards the first position and away from the second piston 34) than when the follower 30 is moving in the opposite direction.

The restriction to fluid flow determines the predetermined time period. That is, the restriction to fluid flow determines the speed at which the first piston 28 moves between the first, second and third positions. By increasing the restriction to fluid flow when the first piston 28 is moving towards the first position from the second, third or an intermediate position, the transition from the second/intermediate/third position to the first position lasts a longer time and it is easier for an operator to increase the flow rate to move the first piston on to the 'next' position, if required.

Figure 16:
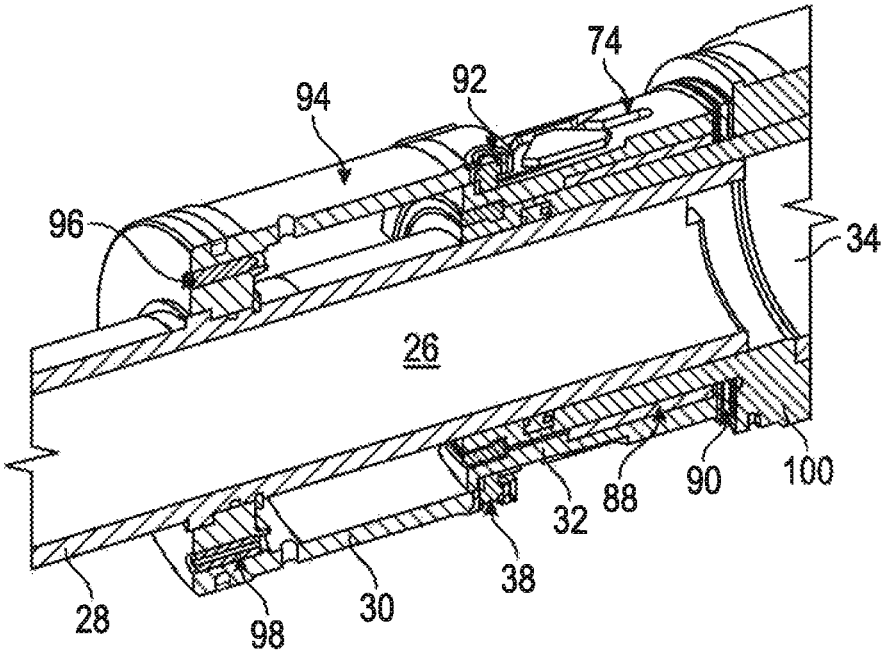
FIG. 16 is a further perspective cross-sectional view of an indexer according to the present disclosure engaged with a follower.

FIG. 16 illustrates the follower 30 and indexer 32 assembly of FIG. 15 mounted on a first piston 28 and cylindrical support member 100. In both FIG. 16 and FIG. 17, the first piston 28 is in the first position.

Figure 17:
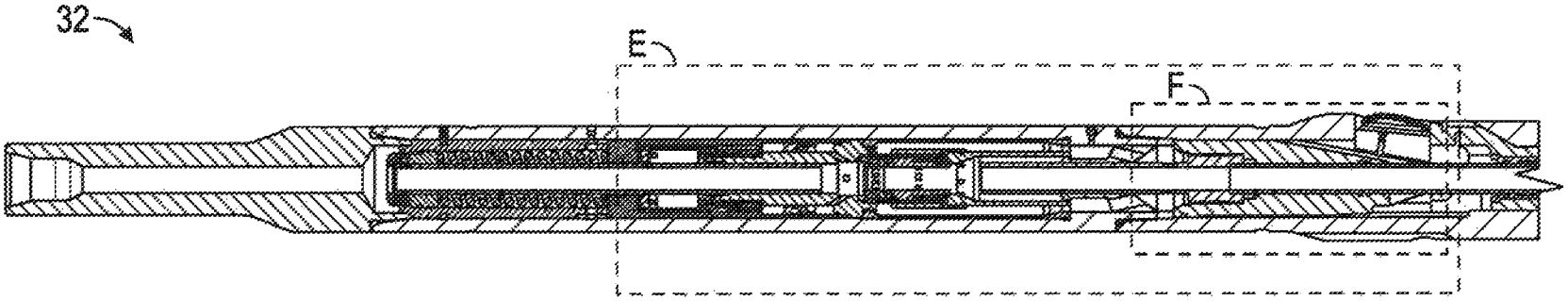
FIG. 17 is a cross-sectional view of part of the tool of FIG. 1.
Figure 18:
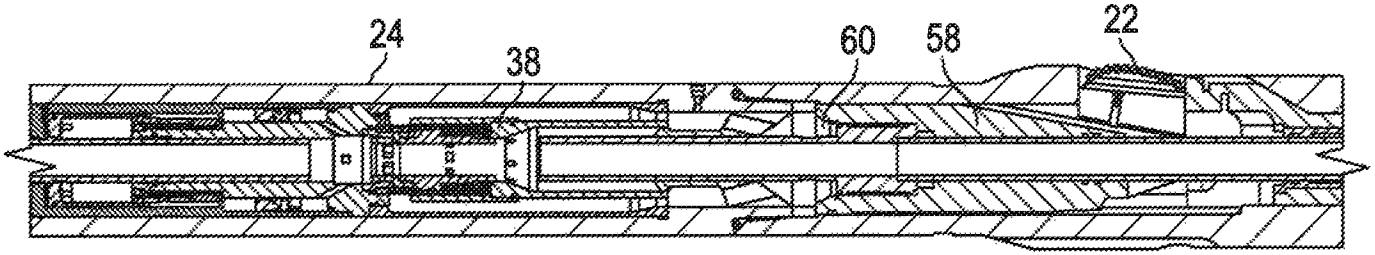
FIG. 18 is an enlarged view of a part of FIG. 17.
Figure 19:
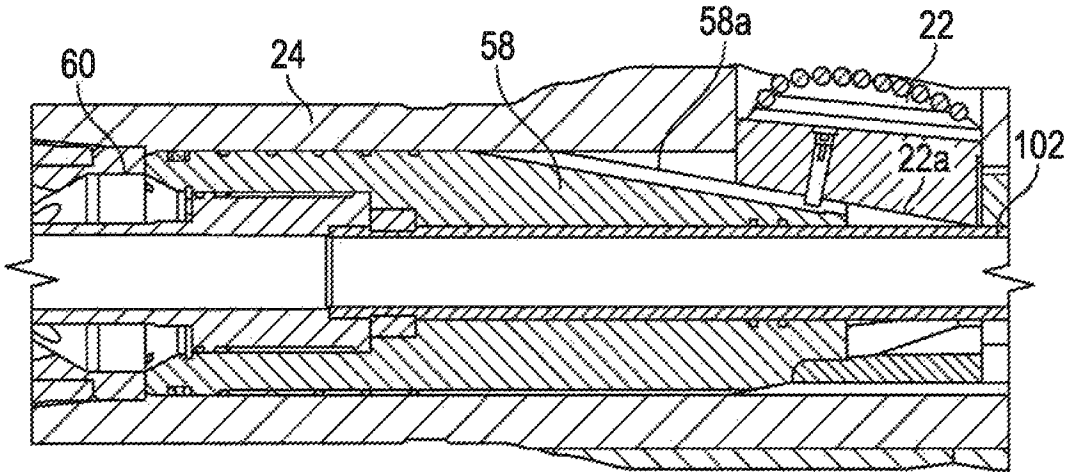
FIG. 19 is a further enlarged view of a part of FIG. 17.
Figure 20:
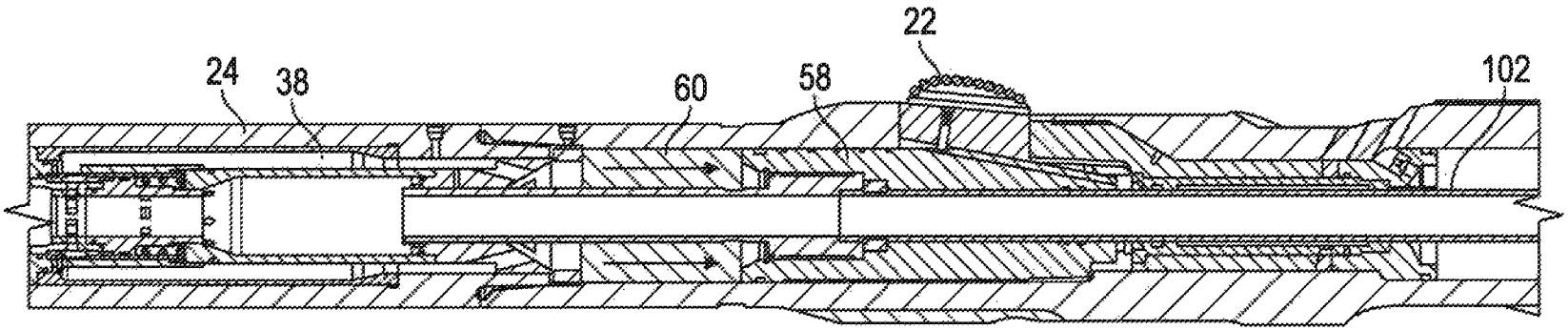
FIG. 20 is a further cross-sectional view of part of the tool of FIG. 1.

FIG. 17 is an enlarged view of a part of FIG. 2. FIG. 18 depicts detail E of FIG. 17. FIG. 19 depicts detail F of FIG. 17. In all of these figures, the first piston 28 is in the first position and, accordingly, the tool 10 is in a deactivated state with the cutter blades 22 in an inactive position. FIG. 20 depicts part of the tool 10 of FIG. 1, in an activated state.

The tool 10 is configured to be activated to extend cutter blades 22 radially out from the housing 24 to engage the side walls of a wellbore. As described above, the tool 10 is configured to allow a user to selectively increase and decrease the pressure in the activation chamber 38. The activation chamber 38 is fluidically connected to a pressure chamber 60 arranged within the housing 24. Axially-slidable wedges 58 are located adjacent or within the pressure chamber 60. As will be described below with reference to FIGS. 21A to 21B, the wedges 58 are biased in a second direction towards the second piston 34, which corresponds to an inactive position of the cutter blades 22.

When the second piston 34 is moved to the open position, the pressure in the activation chamber 38 and hence pressure chamber 60 increases. The pressure in the pressure chamber 60 creates a pressure differential across the wedges 58 which causes the wedges 58 to move axially within the housing 24 towards the first direction (to the right in FIGS. 17 to 20). As the wedges 58 move to the right, the angled surface 58*a* of the wedges engage the cutter blades 22—which also comprise an angled surface 22*a*—and force the cutter blades 22 radially outwards, thus entering an active position as shown in FIG. 20.

When flow through the tool 10 stops, the second piston 34 is moved to the closed position, the pressure in the activation chamber 38 drops and the pressure differential across the wedges 58 reduces. The biasing force is reasserted on the wedges 58 (as described below) and the wedges 58 move in the second direction. Without the wedges 58 holding the cutter blades 22 in an active position, the cutter blades 22 retract into the housing 24, either due to a biasing force provided within the tool or due to the forces inherent in the operation of the tool—e.g. the forces exerted onto the blades 22 by the wellbore.

Figure 21A:
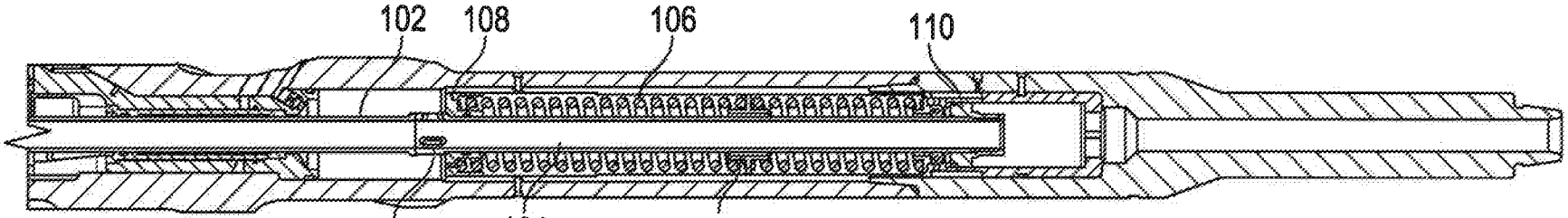
FIGS. 21A to 21C are cross-sectional views of part of the tool of FIG. 1.
Figure 21B:
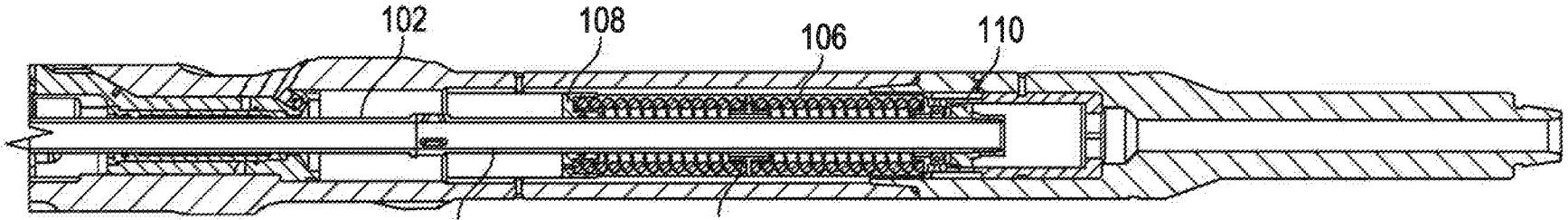
Figure 21C:
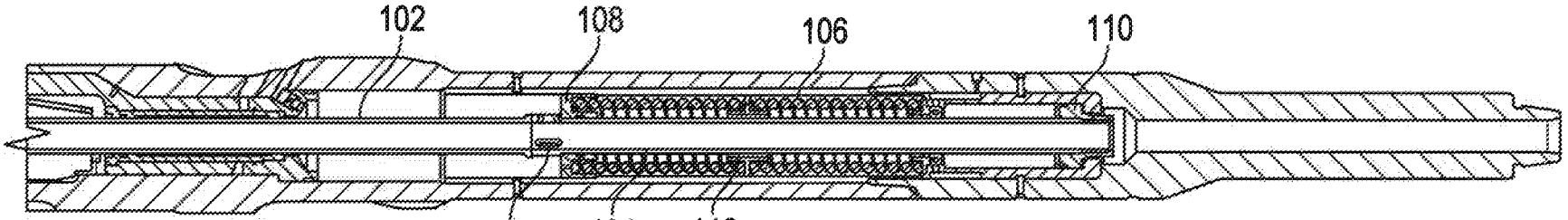

FIGS. 21A to 21C depict a biasing assembly arranged to bias the wedges 58 in the second direction in a first, second and third configuration.

The biasing assembly is connected to the wedges by means of a connector 102, which it in turn connected to a rod 104.

The rod 104 is threaded through and engages a wedge-biasing spring 106, which is fixed at either end to first and second spring-pistons 108 110.

In FIG. 21A there is no fluid flowing through the tool 10. The wedge-biasing spring 106 biases the wedges 58 in the second direction by engaging a protrusion 114 on the rod 104 and urging the rod 104 and connector 102 to the left of FIG. 21A.

Whenever fluid flows though the tool, a port 116 in rod 104 allows high-pressure fluid to act on one side of the first spring-piston 108; the other side of the first spring-piston 108 is exposed to annulus pressure and, as such, the first spring-piston 108 compresses the wedge-biasing spring 106. This arrangement is shown in FIG. 21B. In this arrangement the wedge-biasing spring 106 no longer acts on the rod 104 and connector 102 (and hence the wedges 58) since the first spring-piston 108 no longer contacts the protrusion 114 on the rod 104. In this arrangement, wedges 58 are biased in the second direction by the pressure differential across the second spring-piston 110 caused by the fluid. The second spring-piston 110 is connected to the rod 104, which in turn is connected to the connector 102 and hence the wedges 58; as such, the wedges 58 are biased in the second direction by the fluid pressure.

FIG. 21C shows the biasing assembly when the first piston 28 is in the third position. When the first piston 28 enters the third position and the second piston 34 moves to an open position, the pressure in the activation chamber 34 and pressure chamber 60 (see FIG. 20) increases. The increase in pressure urges the wedges 58 in the first direction. This pressure force is larger than that of the second spring-piston 110 and, as such, the biasing force is overcome and the wedges 58 are urged in the first direction. The connector 102 and rod 104 move with the wedges 58 until the protrusion 114 of the rod abuts the first spring-piston 108 or the second spring-piston abuts the housing 24. When the second spring-piston abuts the housing 24, no, or a low, biasing force is applied to the wedges 58 by wedge-biasing spring 106 or a pressure gradient (as the right hand surface of the second spring-piston is not exposed to fluid flow).

FIGS. 22A to 25B illustrate a further tool 210 according to the disclosure. The tool 210 of FIGS. 22A to 25B is a near-bit reamer. The majority of the features of the tool 10 according to FIGS. 1 to 21C are replicated in the tool 210 of FIGS. 22A to 25B. Accordingly, discussion of the features and operation of this tool 210 is largely identical to that of the previous tool 10 and the discussion provided above applies, mutatis mutandis. Where corresponding components are included in both examples, the reference numerals used for the tool 210 of FIGS. 22A to 24B are equal to those of the tool 10 of FIGS. 1 to 21C advanced by 200. Given the similarity between the examples, detailed comments will not be provided on the tool 210 of FIGS. 22A to 25B.

Figure 22A:
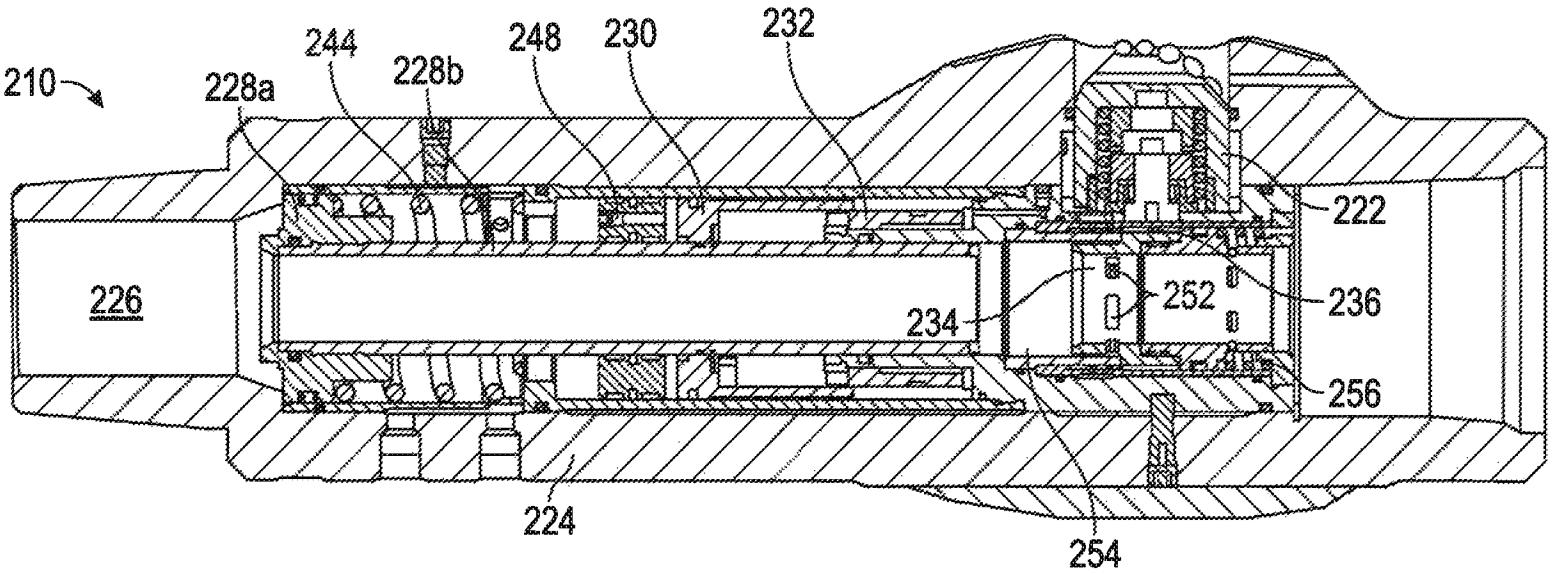
FIGS. 22A to 22C are cross-sectional views of a further tool according to the disclosure.
Figure 22B:
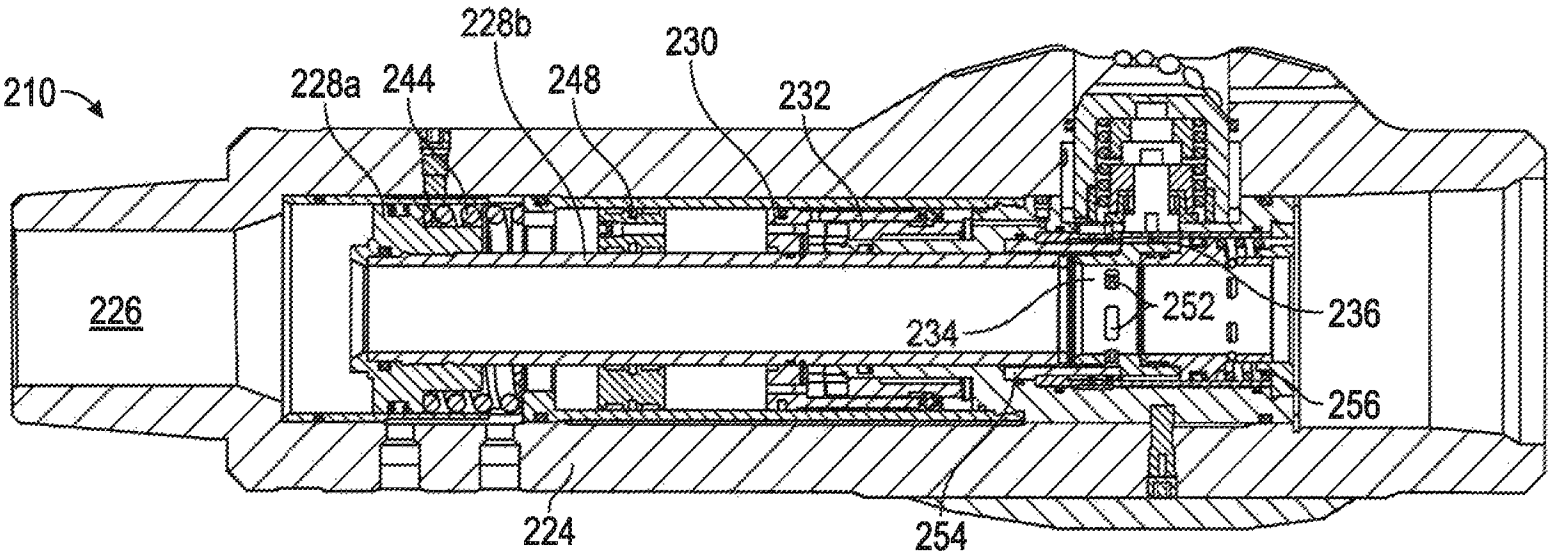
Figure 22C:
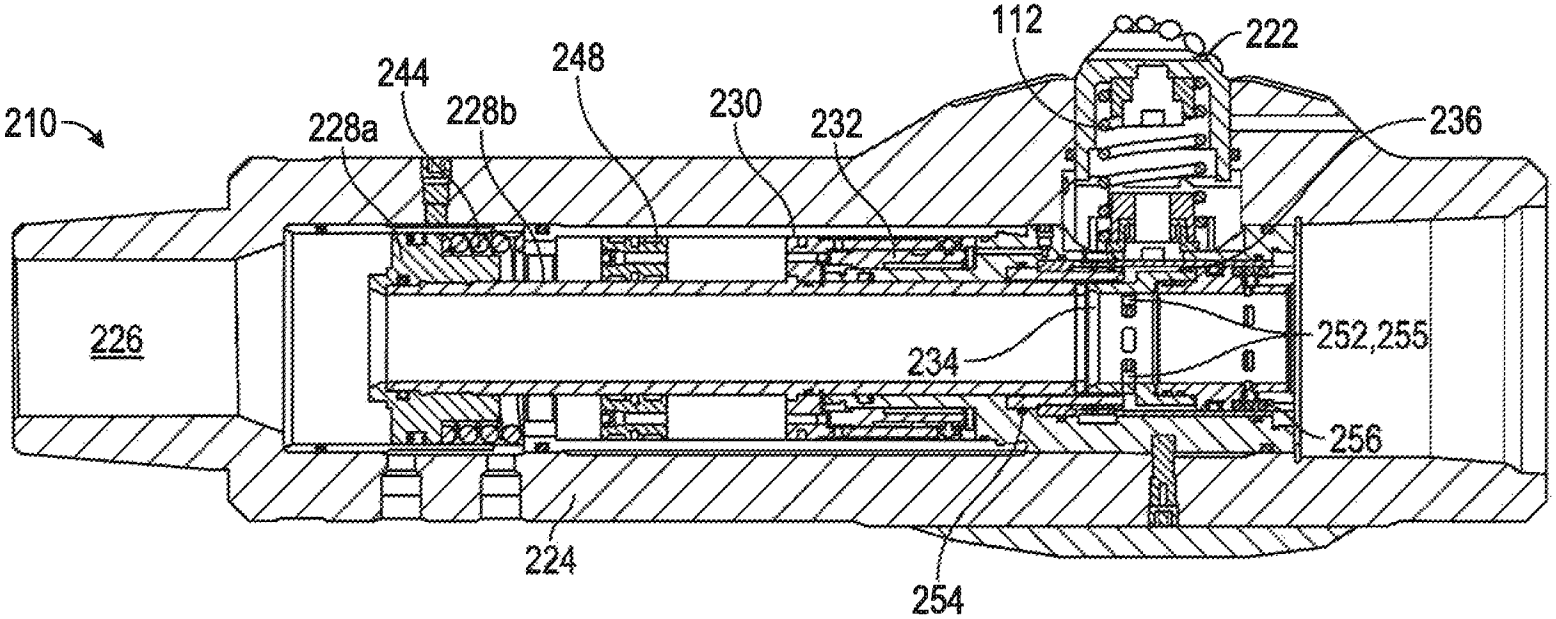

As illustrated in FIGS. 22A to 22C, the tool 210 comprises a substantially cylindrical housing 224 which houses a first piston 228 and associated follower 230, an indexer 232 and a second piston 234. All of the description provided above for corresponding features of the previous example apply, mutatis mutandis, to the features of this example.

The tool 210 is configured to selectively actuate, thus moving a plurality of cutter blades 222 from an inactive to an inactive position. The tool 210 is further configured to selectively deactivate, thus moving the cutter blades 222 from an active position to an inactive position in which they are withdrawn into the housing 226.

In order to move the cutter blades 222 between an active and inactive position, the tool 210 is configured to selectively increase the pressure in an activation chamber 236 by means of moving the second piston between an open and closed position. When fluid pressure in the activation chamber 236 increases, the cutter blades 222 are urged outward, to an active position.

The first piston 228 is configured to move between a first, second and third position, relative to the housing. The first, second and third positions are defined by the indexer 232 which cooperates with a pin 238 of the follower 230, which in turn is fixed with respect to the first piston 228.

Figure 23A:
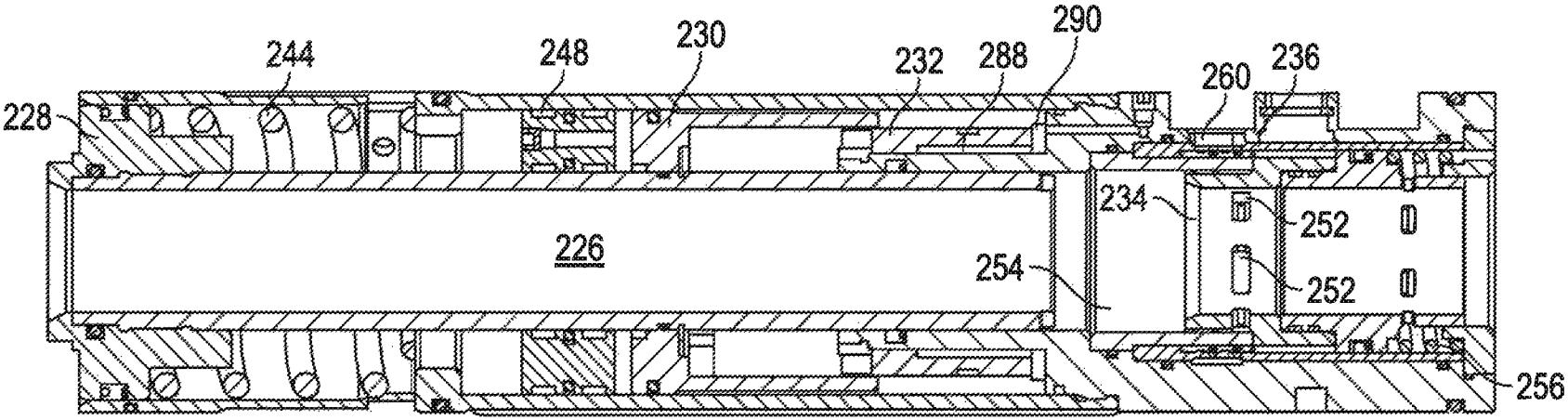
FIGS. 23A to 23C are enlarged views of part of FIGS. 22A to 22C, respectively.

The first position corresponds to an inactive state of the tool 210, when no fluid is flowing through the tool 210. This arrangement is shown in FIGS. 22A and 23A. As can be seen, the first piston 228 is to the left of the figure. The second piston 234 is in a closed position. The second piston 234 is surrounded by a gate member 254 and, when the second piston 234 is in the closed position, the gate member 254 prevents or restricts fluid from flowing from the tool flow path 226 through a series of ports 252 arranged around the second piston 234.

Figure 23B:
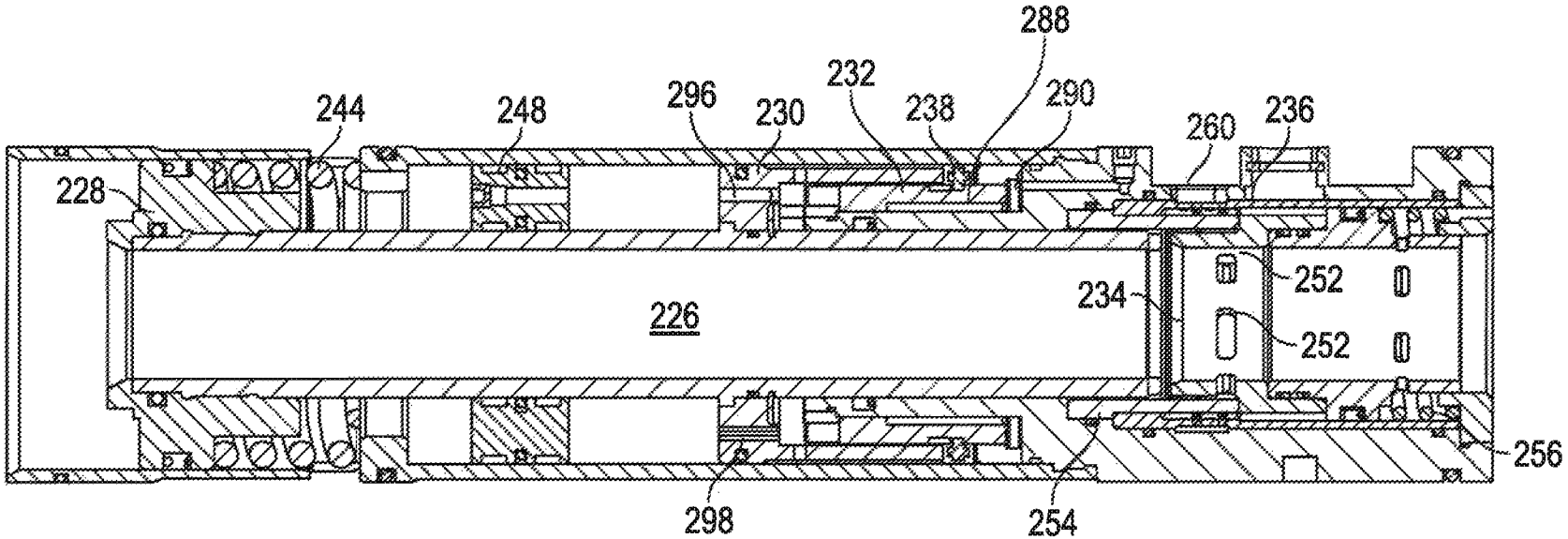
Figure 24A:
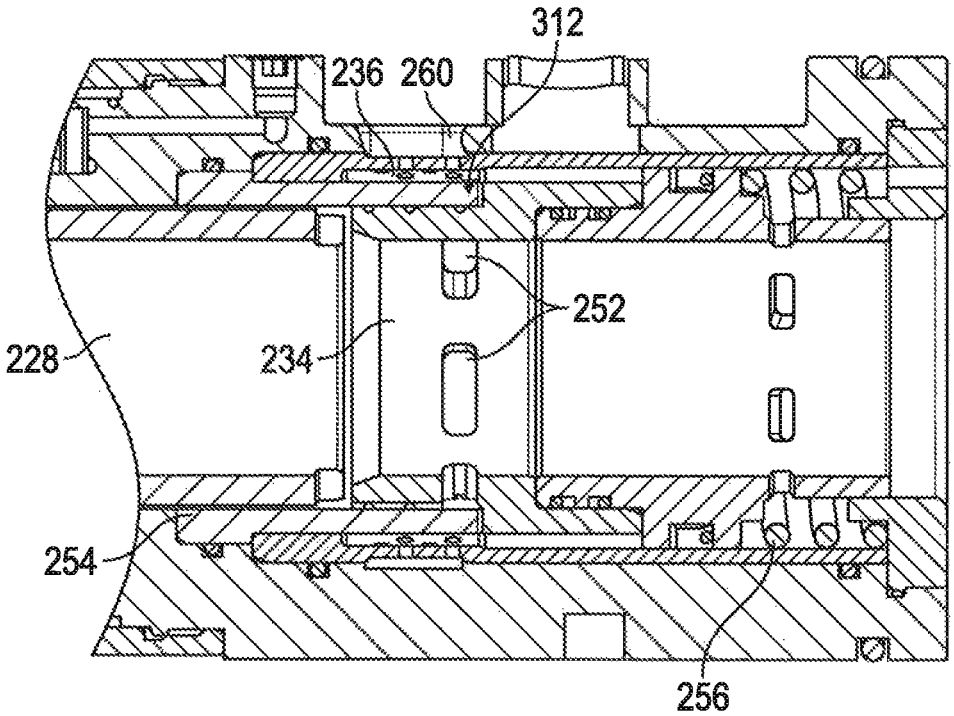
FIGS. 24A and 24B are enlarged view of part of FIGS. 22B and 22C, respectively.

When fluid flows through the tool flow path 226 of the tool 210, the first piston 228 moves to the second position under the action of a pressure differential across the piston to the position shown in FIGS. 22B, 23B and 24A. As can be seen from these figures, the first piston 228 has moved towards the second piston 234 to move from the first to the second position. However, the first piston 228 has not moved axially far enough to engage and move the second piston 234 to the open position. As such, the second piston 234 is still located in a closed position and, as such, the pressure in the activation chamber 236 is low and the cutter blades 222 are located in an inactive position.

Figure 23C:
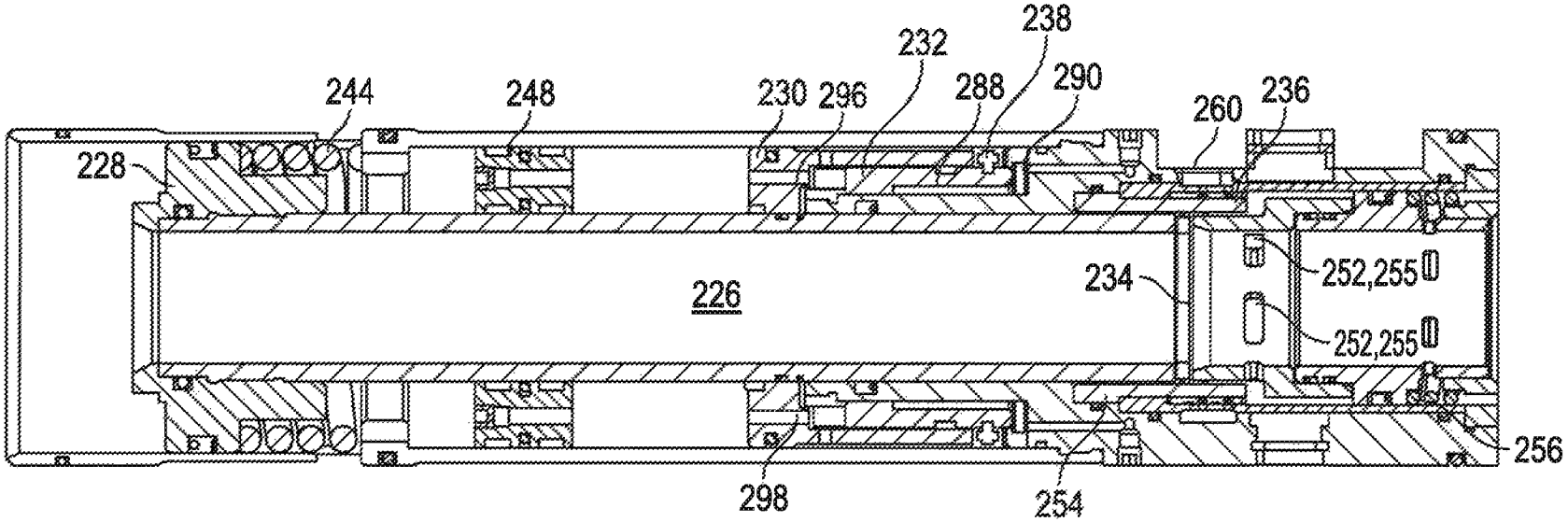
Figure 24B:
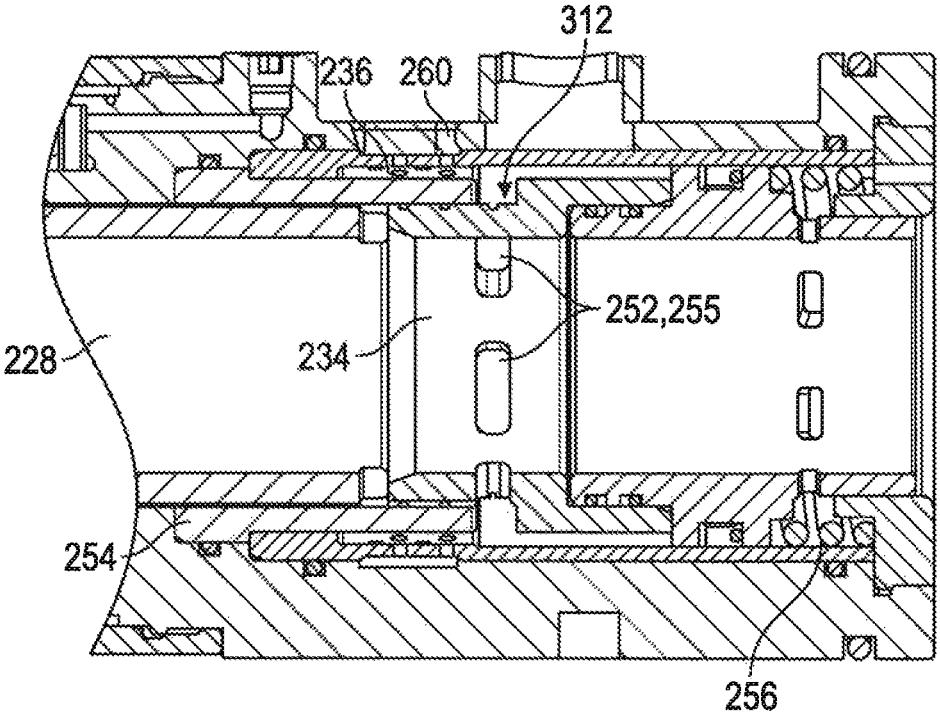

FIGS. 22C, 23C and 24B depict the tool 210 in an activate state, with the cutter blades 222 in an active position (e.g. extended radially outwards from the housing).

The first piston 228 moves to the third position (that shown in FIGS. 22C, 23C and 24B) after a predetermined sequence of flow control operations have been undertaken. The required sequence of actions is determined by the indexer 230, as described above. Once these actions have been undertaken, the first piston 228 moves to the third position which, in turn, moves the second piston 234 to the open position. In the open position, ports 252 of the second piston 234 align with openings 255 in the gate member 254 such that the tool flow path 226 is fluidically connected to the activation chamber 236. Fluid flowing through the tool flow path can now enter the activation chamber 236 and the pressure in the activation chamber 236 increases. The activation chamber 236 is arranged to flow between a gap 312 formed between two opposing surfaces of the second piston 234 and gate member 254. Flow from the tool flow path 226 flows radially outwards through the ports 252, openings 255 and the gap 312 and into a pressure chamber 260 located radially inwards of the cutter blades 222. A pressure chamber 260 fluidically connected to, or formed as part of, the activation chamber 236 exerts a driving force on the blades 222, which are moved to an active position against the action of a blade spring 112 arranged to urge the cutter blades 222 to an inactive position.

When the flow through the tool 210 stops, the pressure gradient across the first piston 228 reduces and the first helical spring 244 urges the first piston 228 away from the second piston 228. The second helical spring 256 urges the second piston 234 in the second direction, closing the ports 252. The pressure thus drops in the activation chamber 236 and the blade spring 112 urges the cutter blades 222 to an inactive position.

Figure 25A:
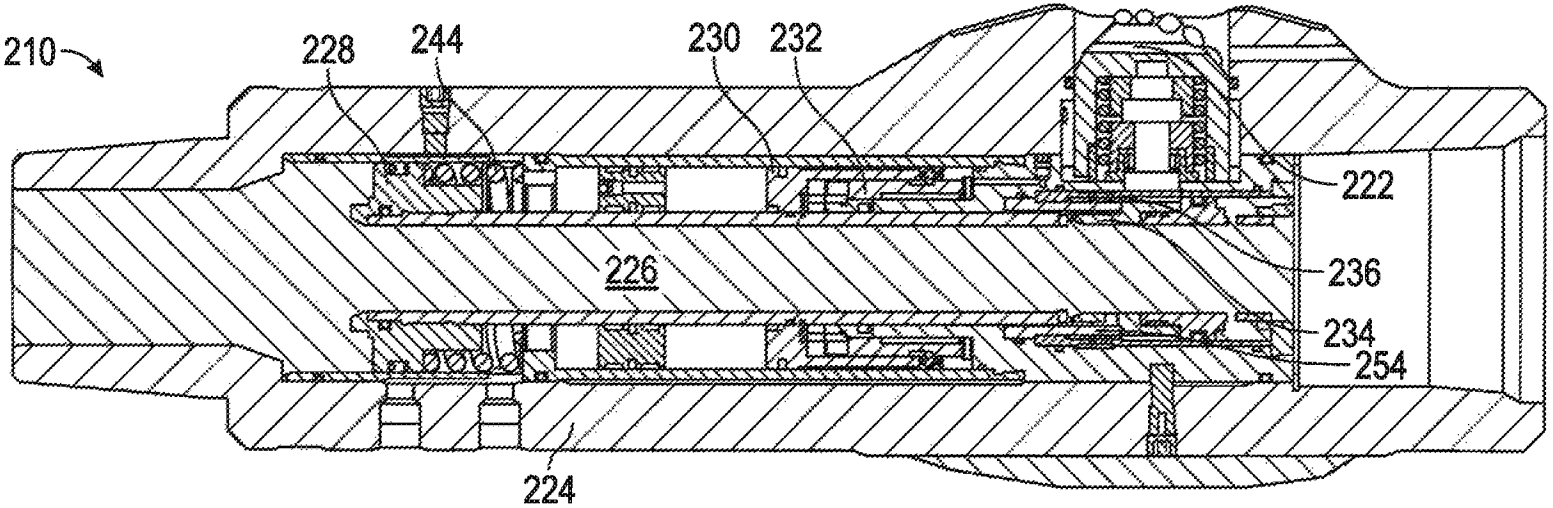
FIGS. 25A and 25B are views of the tool of FIG. 22 schematically illustrating fluid pressure within the tool.
Figure 25B:
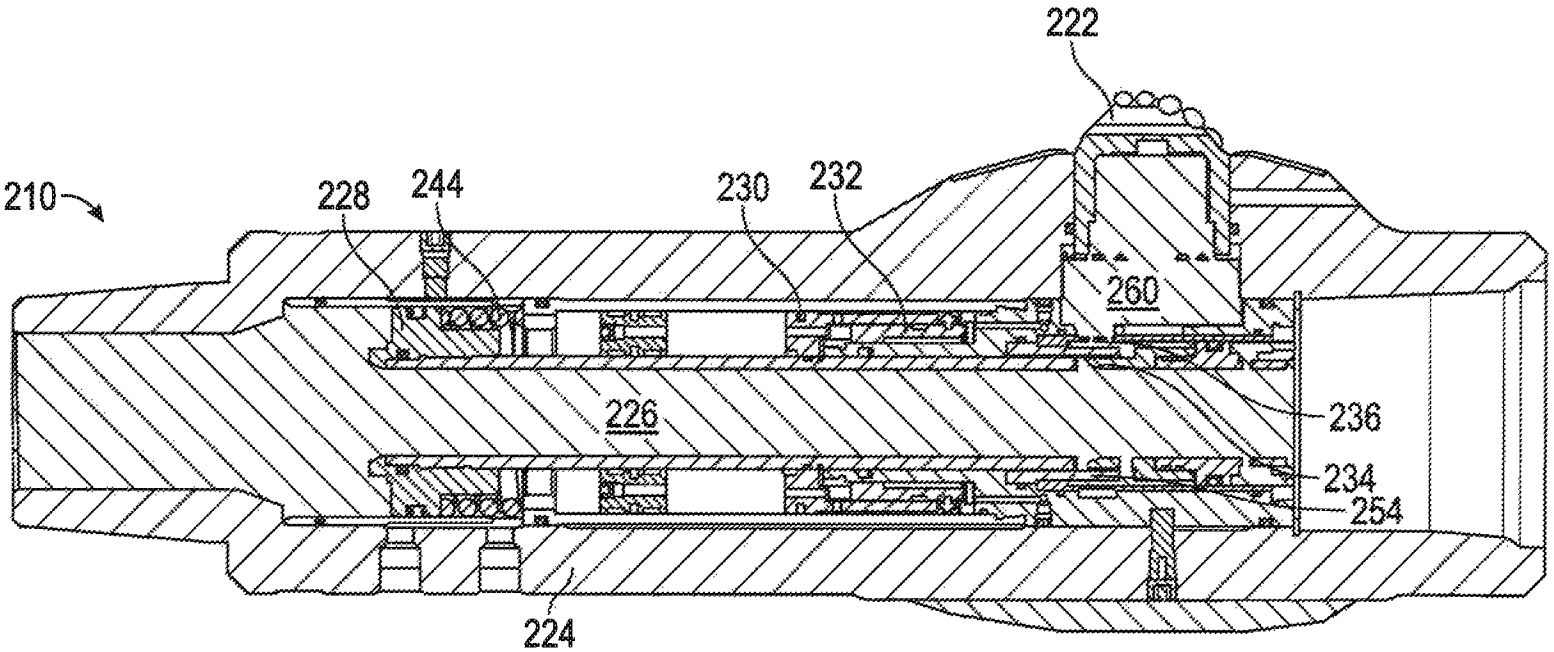

FIGS. 25A and 25B show the tool in an inactive and active state, respectively, with the cutter blades 222 in an inactive and active position. FIGS. 25A and 25B show the distribution of high pressure fluid (shaded) in both the active and inactive arrangement. As can be seen, when the first piston 228 is in the third arrangement, high pressure fluid from the tool flow path has access to the activation chamber 236 and pressure chamber 260, thus urging the cutter blade 222 radially outwards to an active position.

The invention claimed is:

1. A downhole tool comprising:

a housing;

a first piston within the housing configured such that the first piston can move axially under an action of fluid flowing through the tool, wherein the first piston comprises a follower configured to fluidically damp movement of the first piston;

an indexer configured to control axial movement of the first piston between a first, second and third axial position, wherein the indexer is arranged to rotate relative to the first piston;

wherein the indexer is configured such that the first piston can be selectively moved into the third position in accordance with a variation of a flow of fluid through the tool;

a second piston moveable between a closed position in which fluid flowing through the tool is restricted from communicating with an activation chamber and an open position in which fluid flowing through the tool is permitted to communicate with the activation chamber;

wherein the second piston is configured to move between the closed position and the open position in response to the first piston moving to the third axial position.

2. The downhole tool according to claim 1, wherein the tool is configured such that fluid entering the activation chamber reconfigures the downhole tool between an active and an inactive arrangement.

3. The tool according to claim 1, wherein the activation chamber is arranged such that the tool is activated in response to the second piston moving to the open position.

4. The tool according to claim 1, further comprising an unobstructed axial flow path along the centre of the tool.

5. The tool according to claim 1, wherein the first piston is configured to move the second piston between the open and closed positions as the first piston goes to the third position.

6. The tool according to claim 1, wherein the second piston is moved from a closed position to an open position in response to the first piston moving to the third axial position.

7. The tool according to claim 1, wherein the second piston defines openings arranged to define an entry to the activation chamber when the second piston is in the open position, further comprising a gate member comprising a plurality of openings to the activation chamber; wherein the openings in the second piston are arranged to align with those of the gate member when the second piston is in the open position.

8. The tool according to claim 1, further comprising a tool piece configured to move between an active position and an inactive position under the action of fluid in the activation chamber, in response to the second piston moving to the open position.

9. The tool according to claim 1, further comprising a first and second biasing means, wherein the first biasing means is arranged to bias the first piston towards the first position and the second biasing means is configured to bias the second piston towards the first piston.

10. The tool according to claim 1, wherein the indexer is configured such that in order to move the first piston from the first position to the third position, a predetermined sequence of flow control actions must be undertaken, wherein the tool is configured such that the first piston is in:

the first position when no fluid is flowing through the tool, the second position when fluid is flowing through the tool but the predetermined sequence of flow control actions has not been undertaken, and the third position when fluid is flowing through the tool and the predetermined sequence of flow control actions has been undertaken.

11. The tool according to claim 1, wherein the indexer is configured such that the first piston can cycle between the first position and the second position.

12. The tool according to claim 1, wherein the indexer is configured such that the first piston moves to the third position in response to a change of the rate of fluid flow through the tool during the transition from the second position to the first position.

13. The tool according to claim 1, wherein the indexer is configured such that the first piston moves to the third position in response to the flow rate through the tool being increased within a predetermined period of the flow rate being decreased.

14. The tool according to claim 1, wherein the indexer is arranged to rotate relative to the housing.

15. The tool according to claim 1, wherein an end surface of the indexer comprise a profile configured to abut the first piston when the first piston is in the first, second and/or third position to transfer axial loads.

16. The tool according to claim 1, wherein the indexer comprises a plurality of paths which define a pathway profile which defines the first position, the second position and the third position of the first piston, wherein the pathway profile comprises a change in depth arranged to reduce the likelihood of the first piston going straight from the first position to the third position.

17. The tool according to claim 1, wherein the follower is configured to damp the movement of the first piston from the second position towards the first position.

18. The tool according to claim 1, wherein the follower is configured to engage the indexer and the follower and indexer are arranged in a chamber comprising a fluid and the follower defines a first restriction to flow for fluid flowing in one direction and a second restriction to flow for fluid flowing in the other direction.

19. The downhole tool according to claim 1, wherein the follower surrounds a radially outer surface of the first piston and is configured to restrict fluid flow through the downhole tool to damp movement of the first piston.

20. A downhole tubular string comprising a downhole tool, the downhole tool comprising:

a housing;

a first piston within the housing configured such that the first piston can move axially under an action of fluid flowing through the tool, wherein the first piston comprises a follower configured to fluidically damp movement of the first piston;

an indexer configured to control axial movement of the first piston between a first, second and third axial position, wherein the indexer is arranged to rotate relative to the first piston;

wherein the indexer is configured such that the first piston can be selectively moved into the third position in accordance with a variation of a flow of fluid through the tool;

a second piston moveable between a closed position in which fluid flowing through the tool is restricted from communicating with an activation chamber and an open position in which fluid flowing through the tool is permitted to communicate with the activation chamber;

wherein the second piston is configured to move between the closed position and the open position in response to the first piston moving to the third axial position.

21. The downhole tubular string according to claim 20, wherein the follower of the downhole tool surrounds a radially outer surface of the first piston and is configured to restrict fluid flow through the downhole tool to damp movement of the first piston.

22. A method for activating a tool, the method comprising:

providing the tool, wherein the tool comprises a housing, a first piston within the housing configured such that the first piston can move axially under an action of fluid flowing through the tool, wherein the first portion comprises a follower configured to fluidically damp movement of the first piston, an indexer configured to control axial movement of the first piston between a first, second and third axial position, wherein the indexer is arranged to rotate relative to the first piston, and a second piston moveable between a closed position in which fluid flowing through the tool is restricted from communicating with an activation chamber and an open position in which fluid flowing through the tool is permitted to communicate with the activation chamber; and moving the first piston into the third position by varying the flow of fluid through the tool, thus moving the second piston between a closed position in which fluid flowing through the tool is restricted from communicating with an activation chamber and an open position in which fluid flowing through the tool is permitted to communicate with the activation chamber.

23. The method according to claim 22, wherein the follower of the downhole tool surrounds a radially outer surface of the first piston and is configured to restrict fluid flow through the downhole tool to damp movement of the first piston.

* * * * *